US006437663B1

(12) United States Patent
Kii et al.

(10) Patent No.: US 6,437,663 B1
(45) Date of Patent: Aug. 20, 2002

(54) JUNCTION STRUCTURE OF DIELECTRIC STRIP NONRADIATIVE DIELECTRIC WAVEGUIDE AND MILLIMETER-WAVE TRANSMITTING/RECEIVING APPARATUS

(75) Inventors: Hironori Kii; Nobuki Hiramatsu, both of Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/557,860

(22) Filed: Apr. 26, 2000

(51) Int. Cl.[7] ..... H01P 3/16
(52) U.S. Cl. ..... 333/137; 333/125
(58) Field of Search ..... 333/125, 137, 333/239, 33

(56) References Cited

U.S. PATENT DOCUMENTS 2,925,568 A * 2/1960 Baldwin ..... 333/33

FOREIGN PATENT DOCUMENTS

| | | | |
|---|---|---|---|
| EP | 0-767507 | 4/1997 | ..... 333/125 |
| GB | 2-217114 | 10/1989 | ..... 333/137 |
| JP | 6-174824 | 6/1994 | |
| JP | 8-8621 | 1/1996 | |
| RU | 244442 | * 10/1969 | ..... 333/137 |

* cited by examiner

*Primary Examiner*—Justin P. Bettendorf
*Assistant Examiner*—Damian Cathey
(74) *Attorney, Agent, or Firm*—Hogan & Hartson, L.L.P.

(57) ABSTRACT

An object of the present invention is to provide an NRD guide which can be used in a wide band in a state where output levels of distributed high-frequency signals are nearly equal and does not require precise positioning, thereby enhancing mass productivity thereof. The NRD guide comprises a first straight dielectric strip made of cordierite ceramics having a dielectric constant of 4.8 and a dielectric loss of $2.7\times10^{-4}$ (at a measurement frequency of 77 GHz) and having a section of 1.0 mm width×2.25 mm height, and a second dielectric strip joined to the first dielectric strip at a midway position thereof so as to be branched along an arc and bent at an angle of 90°, wherein the first and second dielectric strips are integrally produced, and the radius of curvature r of a junction (branched portion) of the second dielectric strip is 12.7 mm, which is larger than the wavelength $\lambda\approx5$ mm of high-frequency signals of 60 GHz.

12 Claims, 15 Drawing Sheets

JUNCTION STRUCTURE OF DIELECTRIC STRIP NONRADIATIVE DIELECTRIC WAVEGUIDE AND MILLIMETER-WAVE TRANSMITTING/RECEIVING APPARATUS

BACKGROUND OF THE INVENTION

1. Field of the Invention

The present invention relates to a junction structure of dielectric strips which are built in a millimeter-wave integrated circuit and the like to transmit, branch and synthesize high-frequency signals, a nonradiative dielectric waveguide using the junction structure, and a millimeter-wave transmitting/receiving apparatus.

2. Description of the Related Art

A nonradiative dielectric waveguide (hereinafter referred to as an NRD guide) S1 using a conventional dielectric strip for transmitting high-frequency signals of tens GHz is shown in FIG. 17. FIG. 17 is a partially cutaway perspective view of the NRD guide S1, which is formed by joining, above and below a dielectric strip 2 having a rectangular section, parallel plate conductors 1, 3 each having a major surface larger than the top and bottom surfaces of the dielectric strip 2. In the NRD guide S1, in the case where the spacing between the parallel plate conductors 1, 3 is equal to or less than $\lambda/2$ ($\lambda$ denotes a wavelength of high-frequency signals), high-frequency signals with a wavelength more than $\lambda$ are cut off and incapable of entering the spacing between the parallel plate conductors 1, 3. The dielectric strip 2 is interposed between the parallel plate conductors 1, 3, whereby high-frequency signals can propagate inside and along the dielectric strip 2, and radiation waves from high-frequency signals are suppressed by a cut-off effect of the parallel plate conductors 1, 3. The value $\lambda$ is equal to a wavelength of high-frequency (electromagnetic wave) signals propagating in the air. In addition, FIG. 17 is illustrated by cutting away part of the upper parallel plate conductor 3 in order to make the inside visible.

In order to branch high-frequency signals at a midway point of a dielectric strip in such an NRD guide, as shown in FIG. 18, a technique of mounting dielectric strips 11, 12 for branching high-frequency signals in the vicinity of a terminal of a dielectric strip 10 in which high-frequency signals are entered and propagated, and further mounting dielectric strips 13, 14 for propagating high-frequency signals in the vicinity of terminals of the dielectric strips 11, 12, respectively, has been put forth (refer to Papers of the Institute of Electronics, Information and Communication Engineers, C-I Vol. J75-C-I No.1, pp.35–41, January 1992). In this case, the dielectric strip 10 and the dielectric strips 11, 12, and the dielectric strips 11, 12 and the dielectric strips 13, 14 are placed at predetermined spacings so that high-frequency signals are spatially electromagnetically coupled. Besides, at the terminal of the dielectric strip 10 and the tips of the dielectric strips 13, 14, mode suppressors 15 for eliminating unnecessary transmission modes are placed. FIG. 18 is illustrated in perspective of the inside.

Further, as another construction of branching high-frequency signals at a midway point of a dielectric strip in an NRD guide, as shown in FIG. 19, a technique of installing a straight dielectric strip 20 and a curved (U-shaped) dielectric strip 21 so that a curved protrusion of the dielectric strip 21 is in proximity to a midway point of the dielectric strip 20 is well-known (see Japanese Unexamined Patent Publications JP-A 6-174824 (1994) and JP-A 8-8621 (1996), and IEEE TRANSACTIONS ON MICROWAVE THEORY AND TECHNIQUES, Vol. MTT-31, No.8, August 1983, pp.648–654). In this NRD guide S3, part of high-frequency signals entered from an input port 20*a* of the dielectric strip 20 are propagated in the dielectric strip 20 and outputted from an output port 20*b*, and the rest thereof are spatially electromagnetically coupled at the curved protrusion of the dielectric strip 21 and outputted from an output port 21*c*. The dielectric strip 21, which is called a coupler, has a nonreflective terminator 22 at an end thereof opposite to the output port 21*c* and suppresses reflection of high-frequency signals at the nonreflective terminator 22. Here, FIG. 19 is illustrated in perspective of the inside.

The spacing L between the two dielectric strips 20, 21 at the proximate portion thereof is regulated, whereby high-frequency signals can be distributed at a desired branching ratio. It has been general in an NRD guide to distribute high-frequency signals by using a coupler as shown in FIG. 19.

On the other hand, the NRD guide S2 as shown in FIG. 18, in order to match the electromagnetic coupling among the dielectric strips 10–14, needs to place the dielectric strips 10–14 by precisely regulating the spacing thereof, and the component count thereof is considerably high, so that the practical utility thereof is low.

Therefore, an NRD guide using a coupler as shown in FIG. 19 is dominant, whose transmission property of high-frequency signals by frequency is shown in FIG. 20. Regulation is made in a manner that, when high-frequency signals of 60 GHz are entered from the input port 20*a*, the high-frequency signals are divided into halves with almost the same levels and outputted from the output ports 20*b*, 21*c*. Sba denotes an output level of high-frequency signals exiting from the output port 20*b*, and Sca denotes an output level of high-frequency signals exiting from the output port 21*c*. As shown in FIG. 20, the output levels Sba, Sca are largely varied, respectively, when the frequency is shifted from 60 GHz. Therefore, the conventional NRD guide S3 can be used only within a bandwidth of about 1 GHz centered at 60 GHz, exhibiting an insufficient frequency response in the field of communication devices such as a cellular phone which need to be usable in a wide band.

Further, in the NRD guide S3, the output levels Sba, Sca are largely varied when the spacing L between the dielectric strips 20, 21 is varied in FIG. 19, and hence the dielectric strips need to be placed with high accuracy, so that mass productivity of the NRD guide S3 has been prevented from enhancing. In addition, the dielectric strip 21 need to have the nonreflective terminator 22 at one end thereof, and in the case where the NRD guide is used at 60 GHz, the nonreflective terminator 22 becomes approximately 4–20 mm long, whereby downsizing of the NRD guide S3 has been hindered, and design thereof has been restricted.

SUMMARY OF THE INVENTION

Therefore, the present invention, which was made in view of the circumstances mentioned above, is aimed at providing an NRD guide which can be used in a wider band than the conventional one and hence applicable to devices used in a wide band such as communication devices, does not require precise positioning of a dielectric strip and thereby enhances mass productivity thereof, and does not need a nonreflective terminator disposed to a dielectric strip and hence can be designed with high flexibility and downsized.

The invention provides a junction structure of dielectric strips comprising a first straight dielectric strip for propagating high-frequency signals and a second dielectric strip which is joined to the first dielectric strip at a midway point thereof, wherein a junction between the second dielectric strip and the first dielectric strip is formed along an arc and the radius of curvature thereof is equal to or more than the wavelength of the high-frequency signals.

With the construction mentioned above, the invention can be produced in a state where the first dielectric strip and the second dielectric strip are integrated, and does not require precise positioning as in the case of individually placing these dielectric strips, so that mass productivity thereof is enhanced. Moreover, the second dielectric strip does not need to have a nonreflective terminator, so that the invention is highly flexible in design and advantageous for downsizing. In addition, the radius of curvature of the junction of the second dielectric strip is set to be equal to or more than the wavelength of high-frequency signals, so that the invention can be used in a wide band in a state where output levels of distributed high-frequency signals are almost equal to each other, thereby finding wide application to communication devices such as a cellular phone.

Further, the invention provides a nonradiative dielectric waveguide comprising the junction structure of dielectric strips disposed between parallel plate conductors placed at a spacing of $\lambda/2$ or less with respect to a wavelength $\lambda$ of high-frequency signals.

With such a construction, the nonradiative dielectric waveguide of the invention can suppress radiation components from the dielectric strips to propagate high-frequency signals with high efficiency, and can be used in a considerably wider band, so that a general versatility thereof to a communication device, millimeter-wave radar or the like containing a millimeter-wave integrated circuit is increased.

The nonradiative dielectric waveguide of the invention comprises a first straight dielectric strip and a second dielectric strip which is joined to the first dielectric strip at a midway point thereof, wherein a junction between the second dielectric strip and the first dielectric strip is formed along an arc and the radius of curvature thereof is equal to or more than the wavelength of the high-frequency signals. Therefore, the invention can be produced in a state where the first dielectric strip and the second dielectric strip are integrated, and does not require precise positioning, so that mass productivity thereof is enhanced. Moreover, the second dielectric strip does not need to have a nonreflective terminator, so that the invention is highly flexible in design and advantageous for downsizing. In addition, the invention can be used in a wide band in a state where output levels of distributed high-frequency signals are almost equal to each other, thereby increasing a general versatility to a high-frequency circuit and finding wide application to a communication device such as a cellular phone, millimeter-wave radar or the like.

In the nonradiative dielectric waveguide of the invention it is preferable that the radius of curvature of the junction between the second dielectric strip and the first dielectric strip is in a range of from $\lambda$ to $3\lambda$.

According to the invention, the radius of curvature of the junction between the second dielectric strip and the first dielectric strip is selected to be in a range of from $\lambda$ to $3\lambda$, whereby the nonradiative dielectric waveguide is capable of distributing high-frequency signals at nearly equal output strengths and therefore has an advantage in downsizing.

In the nonradiative dielectric waveguide of the invention it is preferable that in the case where the second dielectric strip is elongated along an arc from the junction toward the first dielectric strip, the second dielectric strip is formed so that a tangent of the elongated portion thereof comes in contact with a side wall of the first dielectric strip.

According to the invention, the tangent of the second dielectric strip elongated from the arc-shaped junction comes in contact with a side wall of the first dielectric strip, whereby the nonradiative dielectric waveguide is capable of equally distributing high-frequency signals.

In the nonradiative dielectric waveguide of the invention it is preferable that a frequency of the high-frequency signals is equal to or more than 50 GHz.

In the case where the nonradiative dielectric waveguide of the invention constructed as described above is disposed to automotive millimeter-wave radar, millimeter-waves are guided through the first dielectric strip and applied to an obstruction around the automobile and other automobiles, and intermediate frequency signals are generated by synthesizing reflection waves with high-frequency signals guided through the second dielectric strip, and then analyzed, whereby the distance from the automobile to the obstacle and other automobiles, the moving speeds, the moving directions and the like can be determined.

In the nonradiative dielectric waveguide of the invention it is preferable that the parallel plate conductors are made of Cu, Al, Fe, Ag, Au, Pt or stainless steel.

According to the invention, the parallel plate conductors are made of Cu, Al, Fe, Ag, Au, Pt or stainless steel, whereby the nonradiative dielectric waveguide can obtain high electric conductivity and processibility.

In the nonradiative dielectric waveguide of the invention it is preferable that the first dielectric strip and the second dielectric strip are made of an organic resin material, an organic-inorganic composite or ceramics.

According to the invention, the first dielectric strip and the second dielectric strip are made of an organic resin material, an organic-inorganic composite or ceramics, whereby the nonradiative dielectric waveguide can be easily processed so as to be low-loss with respect to high-frequency signals, and mass-produced.

As shown in FIGS. 6–11, the invention provides a millimeter-wave transmitting/receiving apparatus comprising:

(a) a voltage-controlled oscillating portion 21 comprising:
- a high-frequency diode 33 for outputting high-frequency signals of millimeter-wave band, and
- a variable capacitance diode 30 placed so that a bias voltage applying direction 72 coincides with an electric field direction of the high-frequency signals, for outputting the high-frequency signals as frequency-modulated transmission millimeter-wave signals by periodically controlling bias voltage,
- the voltage-controlled oscillating portion 21 being installed at an end of a first dielectric strip 37*b* (37*a*);

(b) a second dielectric strip 75 which is joined, along an arc having a radius of curvature r not less than the wavelength $\lambda$ of the transmission millimeter-wave signals, to a straight portion 37*b*1 of the first dielectric strip 37*b* on the downstream side from the voltage-controlled oscillating portion 21 in the direction 71 for transmitting the transmission millimeter-wave signals of the first dielectric strip 37*b* (37*a*);

(c) a circulator 76 which has an input end 78, an input/output end 79 and an output end 80,
- the circulator 76 being connected to the other end of the first dielectric strip 37*b* at the input end 78,
- for outputting transmission millimeter-wave signals inputted into the input end 78 to the input/output end 79, and outputting reception signals inputted into the input/output end 79 to the output end 80;

(d) a third dielectric strip 77, one end of which is connected to the input/output end 79 of the circulator 76, and on the other end side of which is disposed a transmission/reception antenna 24;

(e) a fourth dielectric strip 81, one end of which is connected to the output end 80 of the circulator 76;

(f) a mixer 82 for connecting the second dielectric strip 75 and the fourth dielectric strip 81 to mix respective signals transmitted to the second and fourth dielectric strips 75, 81 to generate intermediate frequency signals; and (g) a pair of conductor plates 84, 85 which are placed in parallel at a spacing equal to or less than one half of the wavelength λ of the millimeter-wave signals, in which spacing are disposed the first to fourth dielectric strips 37*a*, 37*b*; 75, 77, 81, the voltage-controlled oscillating portion 21, the circulator 76 and the mixer 82.

The invention provides a millimeter-wave transmitting/receiving apparatus comprising:

(a) a high-frequency diode 33 which outputs high-frequency signals of millimeter-wave band;

(b) a first dielectric strip 37*b* (37*a*), one end of which is connected to the high-frequency diode 33, for propagating high-frequency signals outputted from the high-frequency diode 33;

(c) a pulse-modulating diode interposed between the first dielectric strip 37*b* (37*a*) or installed therealong, so that a bias voltage applying direction 72 coincides with an electric field direction of the high-frequency signals, for outputting transmission millimeter-wave signals which are pulse-modulated signals of the high-frequency signals by on-off of bias voltage;

(d) a second dielectric strip 75 which is joined, along an arc having a radius of curvature r not less than the wavelength λ of the transmission millimeter-wave signals, to a straight portion 37*b*1 of the first dielectric strip 37*b* on the downstream side from the high-frequency diode of the first dielectric strip 37*b* (37*a*) in the transmission direction 71 of the transmission millimeter-wave signals;

(e) a circulator 76 which has an input end 78, an input/output end 79 and an output end 80, the circulator 76 being connected to the other end of the first dielectric strip 37*b* at the input end 78, outputting transmission millimeter-wave signals inputted into the input end 78 to the input/output end 79, and outputting reception signals inputted into the input/output end 79 to the output end 80;

(f) a third dielectric strip 77, one end of which is connected to the input/output end 79 of the circulator 76, and on the other end side of which is disposed a transmission/reception antenna 24;

(g) a fourth dielectric strip 81, one end of which is connected to the output end 80 of the circulator 76;

(h) a mixer 82 for connecting the second dielectric strip 75 and the fourth dielectric strip 81 to mix respective signals transmitted to the second and fourth dielectric strips 75, 81 to generate intermediate frequency signals; and (i) a pair of conductor plates 84, 85 which are placed in parallel at a spacing equal to or less than one half of the wavelength λ of the millimeter-wave signals, in which spacing are disposed the first to fourth dielectric strips 37*a*, 37*b*; 75, 77, 81, the pulse modulating diode, the circulator 76 and the mixer 82.

In the millimeter-wave transmitting/receiving apparatus of the invention it is preferable that the portion 37*b*1 of the first dielectric strip 37*b* on the downstream side is curved so as to make an arc having the radius of curvature r and the second dielectric strip 75 is linearly connected to the arc-shaped portion.

As shown in FIG. 8, in the millimeter-wave transmitting/receiving apparatus of the invention it is preferable that the mixer 82 has a construction of electromagnetically coupling an arc-shaped portion 87 midway in a transmitting direction 86 of the second dielectric strip 75 to a straight or arc-shaped portion 89 midway in a transmitting direction 88 of the fourth dielectric strip 81, so as to be in close proximity to each other.

As shown in FIG. 9, in the millimeter-wave transmitting/receiving apparatus of the invention it is preferable that the mixer 82 has a construction of joining, to a straight portion 91 of the fourth dielectric strip 81, the second dielectric strip 75 along an arc-shaped portion 92 having the radius of the curvature r.

In the millimeter-wave transmitting/receiving apparatus of the invention it is preferable that the mixer 82 has a construction in which the second dielectric strip 75 is connected to the arc-shaped portion 91 of the fourth dielectric strip 81, having the radius of curvature r, so as to make a straight portion 92.

According to the invention, high-frequency signals of millimeter-wave band outputted by the high-frequency diode 33 are passed through the first dielectric strip 37*a*, a bias voltage of the variable capacitance diode 30 by a modulated wave which is periodically varied by a triangular wave or the like, transmission millimeter-wave signals from the voltage-controlled oscillating portion 21 composed of the high-frequency diode 33 and the variable-capacitance diode 30 are passed through the first dielectric strip 37*b* and outputted from the straight portion 37*b*1 of the first dielectric strip 37*b* through the input end 78 of the circulator 76 to the input/output end 79 of the circulator 76 to be radiated from a transmission/reception antenna 24 to a target 104. Reflection waves by the target 104 are supplied from the transmission/reception antenna 24 through the third dielectric strip 77 and guided from the input/output end 79 to the output end 80 of the circulator 76, and the fourth dielectric strip 81 and the second dielectric strip 75 of the mixer 82 are coupled, whereby intermediate frequency signals can be obtained. The mixer 82 may be constructed as shown in FIG. 8 mentioned later, or may be constructed as shown in FIG. 9.

It is possible that high-frequency signals of millimeter-wave band from the high-frequency diode 33 are pulse-modulated to be converted into transmission millimeter-wave signals. In this case, a pulse-modulating diode such as a pin diode or schottky-barrier diode is interposed midway in a transmitting direction 71 of the first dielectric strips 37*a*, 37*b*, or installed therealong, so that a bias voltage applying direction coincides with an electric field direction of the high-frequency signals, for converting the high-frequency signals into pulses by on-off of bias voltage. In the case where the pulse-modulating diode is interposed between the first dielectric strips 37*a*, 37*b*, as the pulse-modulating diode is used a pin diode having a constitution as shown in FIG. 11. In the case where the pulse-modulating diode is installed along the first dielectric strips 37*a*, 37*b*, another circulator is interposed between the first dielectric strips 37*a*, 37*b*, to an input/output end of which is connected another dielectric strip, at an end of which a schottky-barrier diode having a constitution as shown in FIG. 11 is provided. In this case, to input and output ends of the circulator are connected the first dielectric strips 37*a*, 37*b*. The millimeter-wave transmitting/receiving apparatus of the invention may comprise both the voltage-controlled oscillating portion 21 and the pulse modulating diode.

As shown in FIGS. 12–14, the invention provides a millimeter-wave transmitting/receiving apparatus comprising:

(a) a voltage-controlled oscillating portion 21 comprising:
a high-frequency diode 33 for outputting high-frequency signals of millimeter-wave band, and
a variable capacitance diode 30 placed so that a bias voltage applying direction 72 coincides with an electric field direction of the high-frequency signals, for outputting the high-frequency signals as frequency-modulated transmission millimeter-wave signals by periodically controlling bias voltage,
the voltage-controlled oscillating portion 21 being installed at an end of a first dielectric strip 37*b* (37*a*);

(b) a second dielectric strip 75 which is joined, along an arc having a radius of curvature r not less than the wavelength λ of the transmission millimeter-wave signals, to a straight portion 37*b*1 of the first dielectric strip 37*b* on the downstream side from the voltage-controlled oscillating portion 21 in the direction 71 for transmitting the transmission millimeter-wave signals of the first dielectric strip 37*b* (37*a*);

(c) a circulator 76 which has an input end 78, an input/output end 79 and an output end 80,
the circulator 76 being connected to the other end of the first dielectric strip 37*b* at the input end 78,
outputting transmission millimeter-wave signals inputted into the input end 78 to the input/output end 79, and
outputting reception signals inputted into the input/output end 79 to the output end 80;

(d) a third dielectric strip 77, one end of which is connected to the input/output end 79 of the circulator 76, and on the other end side of which is disposed a transmission/reception antenna 121;

(e) a terminator 112 which is connected to the output end 80 of the circulator 76;

(f) a fourth dielectric strip 114 having an end at which a reception antenna 122 is provided, for guiding received millimeter-wave signals;

(g) a mixer 82 for connecting the second dielectric strip 75 and the fourth dielectric strip 114 to mix respective signals transmitted to the second and fourth dielectric strips 75, 114 to generate intermediate frequency signals; and (h) a pair of conductor plates 84, 85 which are placed in parallel at a spacing equal to or less than one half of the wavelength λ of the millimeter-wave signals, in which spacing are disposed the first to fourth dielectric strips 37*a*, 37*b*; 75, 77, 114, the voltage-controlled oscillating portion 21, the circulator 76 and the mixer 82.

A millimeter-wave transmitting/receiving apparatus of the invention comprises:

(a) a high-frequency diode 33 which outputs high-frequency signals of millimeter-wave band;

(b) a first dielectric strip 37*b* (37*a*), one end of which is connected to the high-frequency diode 33, for propagating high-frequency signals outputted from the high-frequency diode 33;

(c) a pulse-modulating diode interposed between the first dielectric strip 37*b* (37*a*) or installed therealong, so that a bias voltage applying direction 72 coincides with an electric field direction of the high-frequency signals, for outputting transmission millimeter-wave signals which are pulse-modulated signals of the high-frequency signals by on-off of bias voltage;

(d) a second dielectric strip 75 which is joined, along an arc having a radius of curvature r not less than the wavelength λ of the transmission millimeter-wave signals, to a straight portion 37*b*1 of the first dielectric strip 37*b* on the downstream side from the high-frequency diode of the first dielectric strip 37*b* (37*a*) in the transmission direction 71 of the transmission millimeter-wave signals;

(e) a circulator 76 which has an input end 78, an input/output end 79 and an output end 80,
the circulator 76 being connected to the other end of the first dielectric strip 37*b* at the input end 78,
for outputting transmission millimeter-wave signals inputted into the input end 78 to the input/output end 79, and
outputting reception signals inputted into the input/output end 79 to the output end 80;

(f) a third dielectric strip 77, one end of which is connected to the input/output end 79 of the circulator 76, and on the other end side of which is disposed a transmission antenna 121;

(g) a terminator 112 which is connected to the output end 80 of the circulator 76;

(h) a fourth dielectric strip 114 having an end at which a reception antenna 122 is provided, for guiding received millimeter-wave signals;

(i) a mixer 82 for connecting the second dielectric strip 75 and the fourth dielectric strip 114 to mix respective signals transmitted to the second and fourth dielectric strips 75, 114 to generate intermediate frequency signals; and (j) a pair of conductor plates 84, 85 which are placed in parallel at a spacing equal to or less than one half of the wavelength λ of the millimeter-wave signals, in which spacing between the conductor plates 84, 85 are disposed the first to fourth dielectric strips 37*a*, 37*b*; 75, 77, 114, the pulse-modulating diode, the circulator 76 and the mixer 82.

In the millimeter-wave transmitting/receiving apparatus of the invention it is preferable that the portion 37*b*1 of the first dielectric strip 37*b* on the downstream side is curved so as to make an arc having the radius of curvature r and the second dielectric strip 75 is linearly connected to the arc-shaped portion.

As shown in FIG. 13, in the millimeter-wave transmitting/receiving apparatus of the invention it is preferable that the mixer 82 has a construction of electromagnetically coupling an arc-shaped portion 115 midway in a transmitting direction 86 of the second dielectric strip 75 to a straight or arc-shaped portion 116 midway in a transmitting direction 88 of the fourth dielectric strip 114, so as to be in close proximity to each other.

As shown in FIG. 14, in the millimeter-wave transmitting/receiving apparatus of the invention it is preferable that the mixer 82 has a construction of joining, to a straight portion 118 of the fourth dielectric strip 114, the second dielectric strip 75 along an arc-shaped portion 119 having the radius of curvature r.

In the millimeter-wave transmitting/receiving apparatus of the invention it is preferable that the mixer 82 has a construction in which the second dielectric strip 75 is connected to the arc-shaped portion 118 of the fourth dielectric strip 114, having the radius of curvature r, so as to make a straight portion 119.

According to the invention, high-frequency signals of millimeter-wave band outputted by the high-frequency diode 33 are passed through the first dielectric strip 37*a*, and transmission millimeter-wave signals which are obtained by modulating the bias voltage of the variable capacitance diode 30 by a modulated wave which is periodically varied by a triangular wave or the like, are supplied through the first dielectric strip 37*b* to the input end of the circulator 76. The transmission millimeter-wave signals outputted from the input/output end 79 of the circulator 76 are radiated, through the third dielectric strip 77, from a transmission antenna 121 toward a target 104.

It is possible that high-frequency signals of millimeter-wave band are pulse-modulated to be converted into transmission millimeter-wave signals. In this case, a pulse-modulating diode such as a pin diode or schottky-barrier diode is interposed midway in a transmitting direction 71 of the first dielectric strips 37*a*, 37*b*, or installed therealong, so that a bias voltage applying direction coincides with an electric field direction of the high-frequency signals, for converting the high-frequency signals into pulses by on-off of bias voltage.

Reflection waves by the target 104 are received by a reception antenna 122 and supplied through a fourth dielectric strip 114 to the mixer 82. To the mixer 82, transmission millimeter-wave signals from the second dielectric strip 75 joined along an arc to the straight portion 37*b*1 of the first dielectric strip 37*b* are supplied. Thus, with the mixer 82, intermediate frequency signals mixed the reflection waves received from the reception antenna 122 and the transmission millimeter-wave signals from the second dielectric strip 75 can be obtained.

The reflection waves by the target 104 are also supplied to the transmission antenna 121, and supplied from the circulator 76 via the output end 80 of the circulator 76 to a terminator 112. The signals supplied to the terminator 112 are heat-consumed without generating reflection waves.

The mixer 82 may be constructed as shown in FIG. 13, or may be constructed as shown in FIG. 14.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
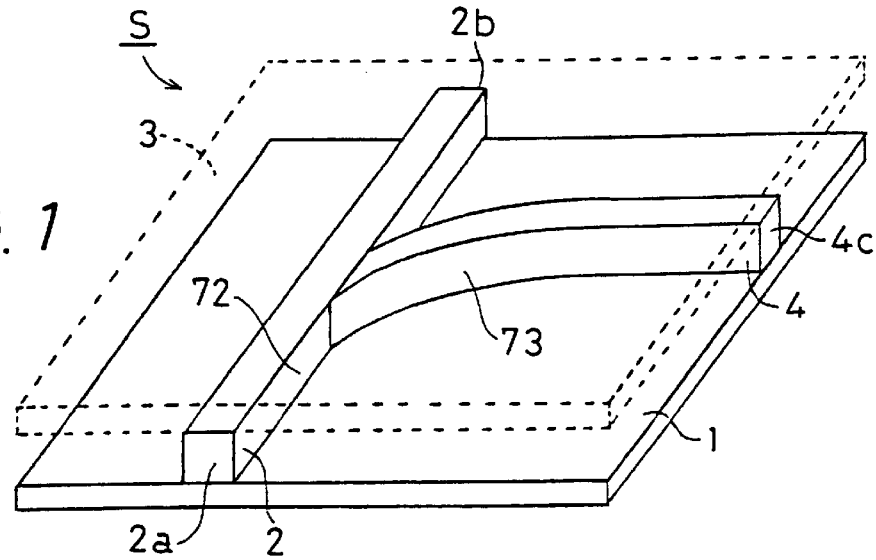
FIG. 1 is a perspective view showing the inside of an NRD guide S with a junction structure of a dielectric strip of the invention.

Now referring to the drawings, preferred embodiments of the invention are described below.

Figure 2:
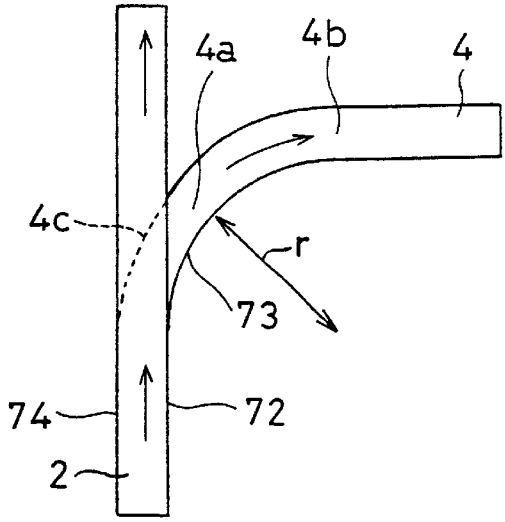
FIG. 2 is a plan view showing the junction structure of a dielectric strip as shown in FIG. 1.
Figure 3:
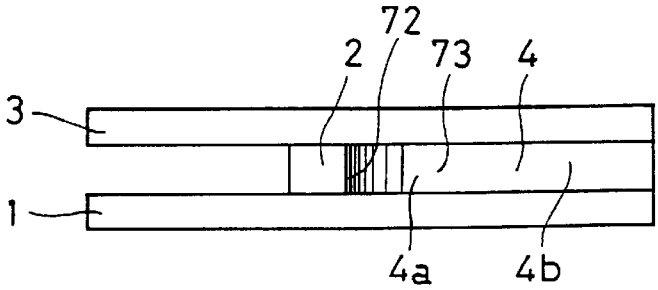
FIG. 3 is a front view of a NRD guide S as shown in FIGS. 1 and 2.

A junction structure of a dielectric strip and an NRD guide of the present invention will be explained below. FIG. 1 is a perspective view of the inside of an NRD guide S of the invention, and FIG. 2 is a plan view of a junction structure of a dielectric strip of the invention. FIG. 3 is a front view of a NRD guide S as shown in FIGS. 1 and 2. In FIG. 1, reference numerals 1, 3 denote a pair of parallel plate conductors, reference numeral 2 denotes a first straight dielectric strip, and reference numeral 4 denotes a second dielectric strip which is joined to the first dielectric strip 2 at a midway point thereof so as to branch and a junction of which is formed like an arc. Further, reference numeral 2*a* denotes an input port of the first dielectric strip 2, reference numeral 2*b* denotes an output port of the first dielectric strip 2, and reference numeral 4c denotes an output port of the second dielectric strip 4. Here, FIG. 1 is illustrated in perspective of the inside. Along one side surface 72 of the first dielectric strip 2, the second dielectric strip 4, one side surface 73 inward in the radius direction of which is bent, ranges in the tangent direction. The first dielectric strip 2 and the second dielectric strip 4 have the same section shape, which is rectangular or square.

In the invention, the second dielectric strip 4 is formed like an arc at least at the junction 4*a* thereof, and may be formed by modifying in a manner that the rest 4*b* thereof other than the junction 4*a* is formed straight, the overall shape of the second dielectric strip 4 is formed like an arc, or the rest thereof other than the junction 4*a* is formed like a curve such as an elliptic curve, a hyperbolic curve, a quadratic curve, or a waveform curve. Then, as shown in FIG. 2, the radius of curvature r of the junction of the second dielectric strip 4 is set to be equal to or more than a wavelength λ of high-frequency signals propagating within the dielectric strips 2 and 4, whereby the high-frequency signals can be distributed by the first dielectric strip 2 and the second dielectric strip 4 at almost equal output levels. Besides, the radius of curvature r of the junction 4*a* is preferred to be equal to or less than 3λ. In the case where the radius of curvature is more than 3λ, the junction structure gets large, so that a merit of downsizing cannot be attained.

On the contrary, in the case where the radius of curvature r of the junction 4*a* is set to be less than the wavelength λ, a branching strength to the second dielectric strip 4 gets small.

Further, the second dielectric strip 4 is preferred to have a shape such that in the case where the arc-shaped junction 4*a* is imaginarily elongated as shown by a dot line in FIG. 2, the tangent thereof comes in contact with a side wall 74 of the first dielectric strip 2. This is optimal for equal distribution of high-frequency signals.

Then, the first dielectric strip 2 and the second dielectric strip 4 integrated in the construction described above are installed between the parallel plate conductors 1, 3, whereby without precise positioning, a dielectric strip for propagating high-frequency waves, an NRD guide S, and the like which have a preferable frequency response can be produced with ease. Further, the NRD guide S of the invention can be applied to a high-frequency circuit using high-frequency signals in a band of 20 to 500 GHz, and can be preferably used in a high-frequency band of, specifically, 50 GHz or more, more specifically, 70 GHZ or more. To be specific, the NRD guide S of the invention is to be used in a cellular phone, automotive millimeter-wave radar and the like. For example, by guiding millimeter-waves through the first dielectric strip 2 to irradiate to obstacles and automobiles around an automobile, synthesizing reflection waves with high-frequency waves from the second dielectric strip 4 to obtain intermediate frequency signals, and analyzing the intermediate frequency signals, the distances to the obstacles and the automobiles, the moving speeds thereof, the moving directions thereof and the like can be found.

The parallel plate conductors 1, 3 used in the invention, in view of a high electric conductivity and a processibility, maybe conductor plates made of Cu, Al, Fe, SUS (stainless steel), Ag, Au, Pt or the like, or insulation plates with such conductor layers formed on the surfaces thereof.

Further, the first dielectric strip 2 and the second dielectric strip 4 are preferred to be made of a fluororesin, e.g., an organic resin material of low loss such as Teflon (trade name), an organic-inorganic composite, or a ceramics material having low permittivity such as cordierite, alumina or glass ceramics, which are low-loss to high-frequency waves, easy to process, and suitable to mass production. To be more specific, the dielectric strips 2, 4 are preferred to be made of a ceramics material, and the first dielectric strip 2 and the second dielectric strip 4 can be integrally molded and sintered, so that workability is increased and the strips are complete as compared with the case of individually producing and joining the strips.

Then, in the case of producing the first dielectric strip 2 and the second dielectric strip 4 by a ceramics material, the strips can be produced by, for example, preparing a mold for the construction described above, charging powder of ceramics into the mold and pressurizing to produce a molded member, and thereafter sintering the member.

With another method, the strips can be produced by printing and coating a slurry containing powder of ceramics for the construction described above, drying and thereafter sintering the slurry. Otherwise, such a method may be adopted as pouring an organic resin for binder containing powder of ceramics into a mold, hardening the resin, and thereafter taking out to sinter the resin. Besides, the first dielectric strip 2 and the second dielectric strip 4 may be individually produced, and thereafter adhered by an adhesive.

Further, in the case where the material of the first dielectric strip 2 and the second dielectric strip 4 is an organic resin material or an organic-inorganic composite, the strips can be produced by well-known methods such as a stamping method, an injection molding method or a print-coating method.

Figure 4:
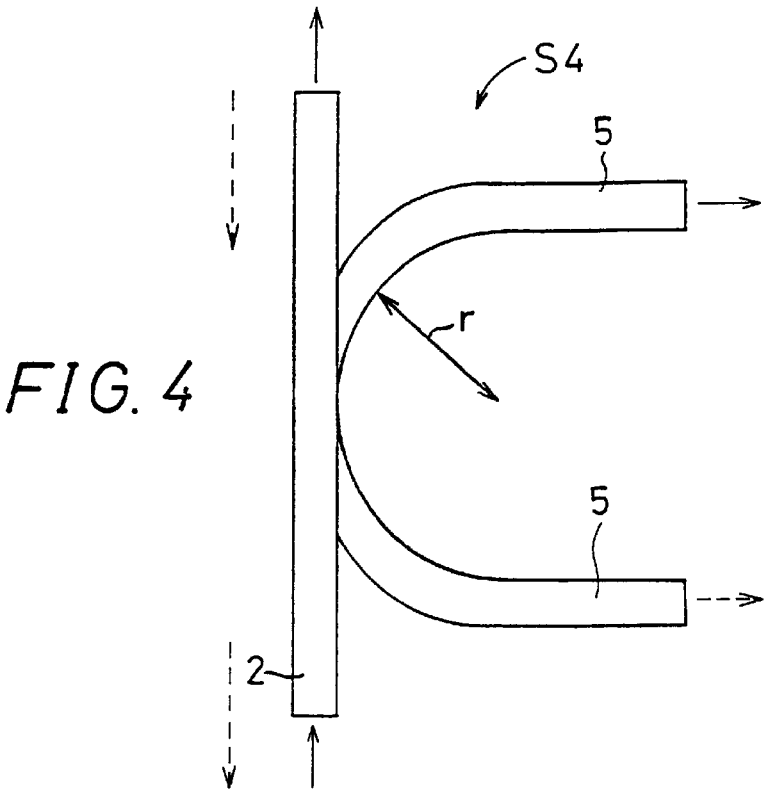
FIG. 4 shows an embodiment of the junction structure of the invention, and is a plan view thereof with a U-shaped second dielectric strip.
Figure 5:
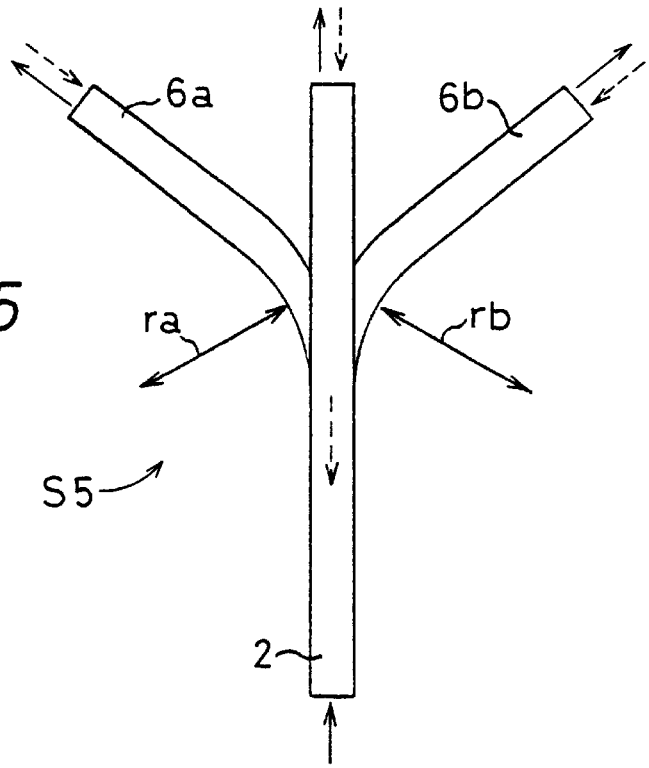
FIG. 5 shows an embodiment of the junction structure of the invention and is a plan view thereof with two second dielectric strips.

Another embodiment of the invention will be shown in FIGS. 4 and 5. FIG. 4 shows a NRD guide S4 in which a pair of U-shaped second dielectric strips 5 is disposed to switch an input/output direction of high-frequency signals in reverse, and FIG. 5 shows a NRD guide S5 in which two dielectric strips 6*a*, 6*b* are disposed so that high-frequency signals are branched into three. In FIG. 5, the radius of curvature ra of the second dielectric strip 6*a* and the radius of curvature rb of the second dielectric strip 6*b* may be equal to or different from each other. Moreover, three or more second dielectric strips 6*a*, 6*b* may be disposed.

Further, in the embodiments mentioned above, a case of branching high-frequency signals is illustrated, whereas the input port of high-frequency signals may be reversed to synthesize high-frequency signals. Moreover, the junction structure of a dielectric strip of the invention can be applied not only to a NRD guide, but also to various types of electronic components, electronic circuits, optical electronic circuits and the like which use a dielectric strip for transmitting high-frequency signals.

Thus, the invention can be produced with the first dielectric strip and the second dielectric strip integrated and does not require precise positioning, so that mass productivity thereof is enhanced. Moreover, the second dielectric strip does not need to have a nonreflective terminator, so that the invention is flexible in design and advantageous for downsizing. In addition, the invention can be used in a wide band in a state where output levels of distributed high-frequency signals are almost equal, whereby application thereof to communication devices such as a cellular phone is broadened.

Here, the invention is not limited to the embodiments mentioned above, and may be modified within the scope of the invention.

An experiment regarding the invention will be explained below.

Experiment

The NRD guide S and the junction structure of a dielectric strip as shown in FIGS. 1 to 3 were constructed in the following manner. The first straight dielectric strip 2 was made of cordierite ceramics having a dielectric constant of 4.8 and a dielectric loss of $2.7\times10^{-4}$ (at a measurement frequency of 77 GHz) and having a section of 1.0 mm width×2.25 mm height, and the second dielectric strip 4 was joined to the first dielectric strip 2 at a midway position thereof so as to be branched along an arc and bent at an angle of 90°, which were integrally produced. At this moment, the radius of curvature r of a junction (branched portion) 4*a* of the second dielectric strip 4 was 12.7 mm, which was larger than the wavelength $\lambda \approx 5$ mm of high-frequency signals of 60 GHz. In this case, the first dielectric strip 2 and the second dielectric strip 4 were integrally produced by preparing molds for the strips, filling powder of cordierite ceramics into the molds and pressurizing to produce molded members, and thereafter sintering the members.

Subsequently, the top and bottom surfaces of the integrated dielectric strips 2, 4 were interposed between the two parallel plate conductors 1, 3 made of Cu which had a dimension of 100 mm depth×100 mm width×8 mm thickness, whereby the NRD guide S was produced.

In this experiment, the first and second dielectric strips 2, 4 were made of ceramics having relatively high dielectric constant, so that it was possible to make the radius of curvature r relatively small. Therefore, the NRD guide S can be used as an NRD module and the invention can be implemented as, for -example, a coupler for radar modules, a transmission/reception device and the like.

Figure 19:
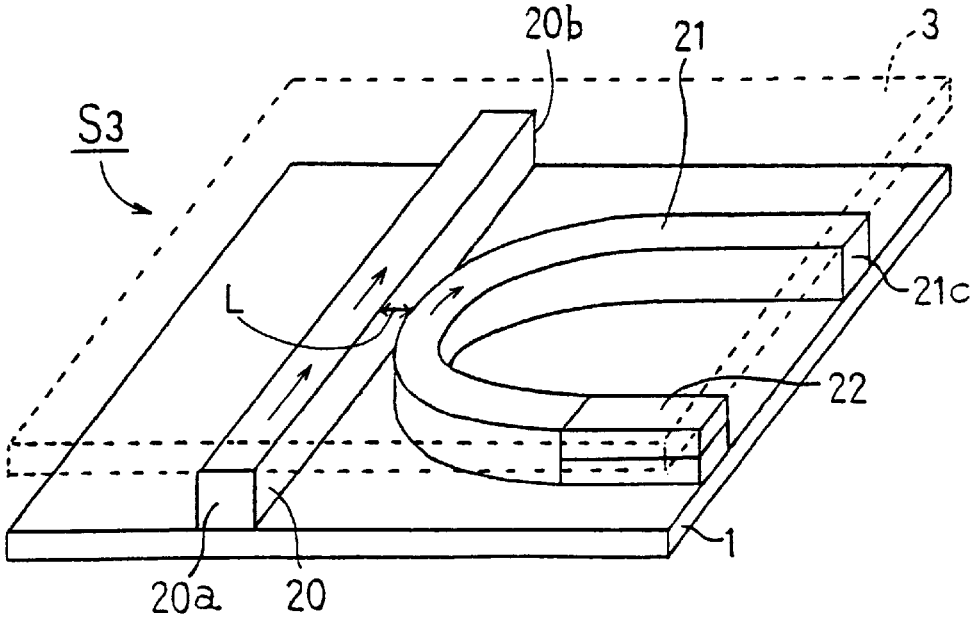
FIG. 19 PRIOR ART
FIG. 19 is a perspective view of the inside of an NRD guide S3 constituting a distribution circuit by a directional coupler.

On the other hand, as a comparison example, the coupler type of NRD guide S3 as shown in FIG. 19 was produced. The materials and the sectional shapes of the parallel plate conductors 1, 3 and the dielectric strips 20, 21 were to be the same as those of the above-mentioned experimental example, and the spacing L between the dielectric strip 20 and the dielectric strip 21 was optimized so that high-frequency signals of 60 GHz were divided into halves.

Figure 16:
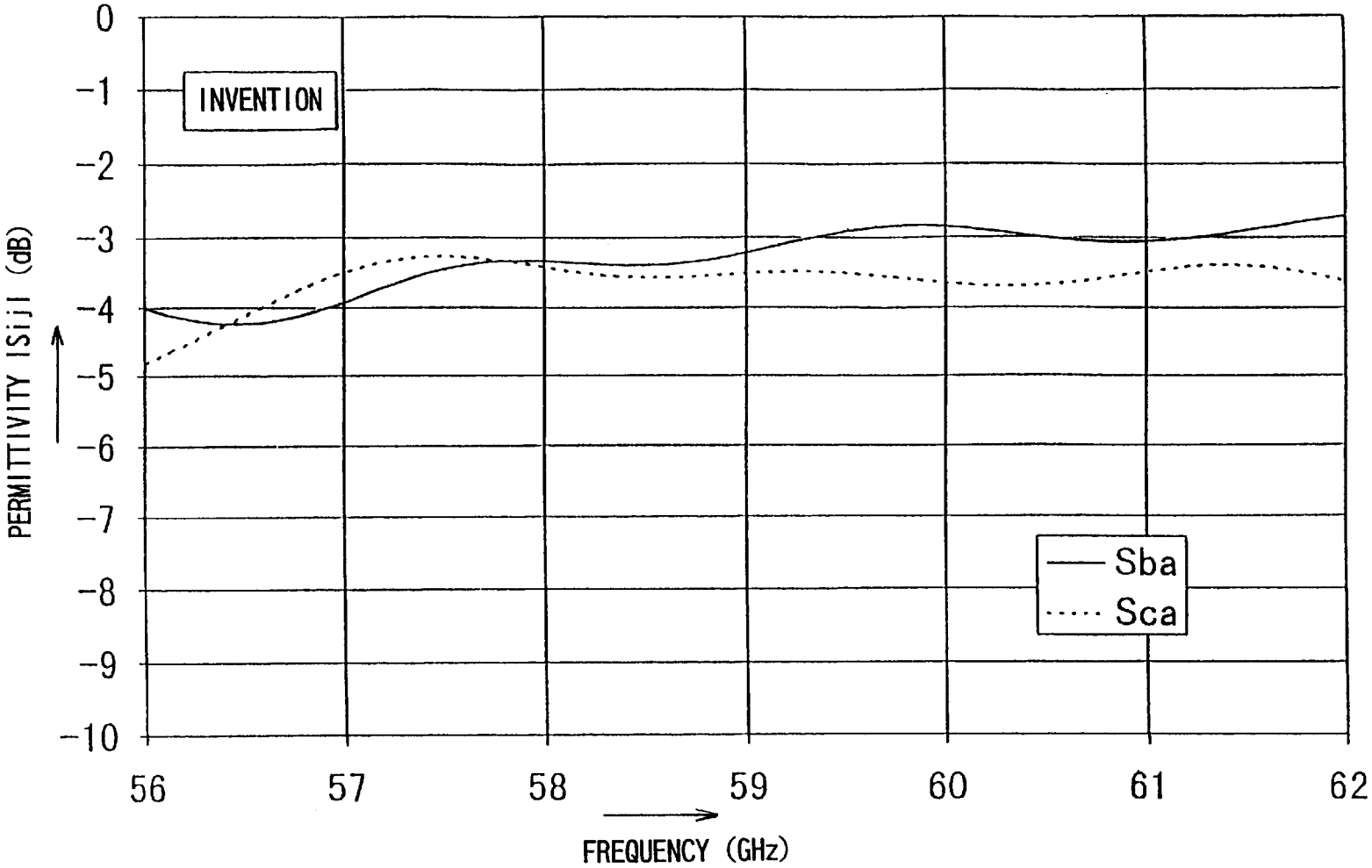
FIG. 16 is a graph of the frequency response of the NRD guide S of the invention.
Figure 17:
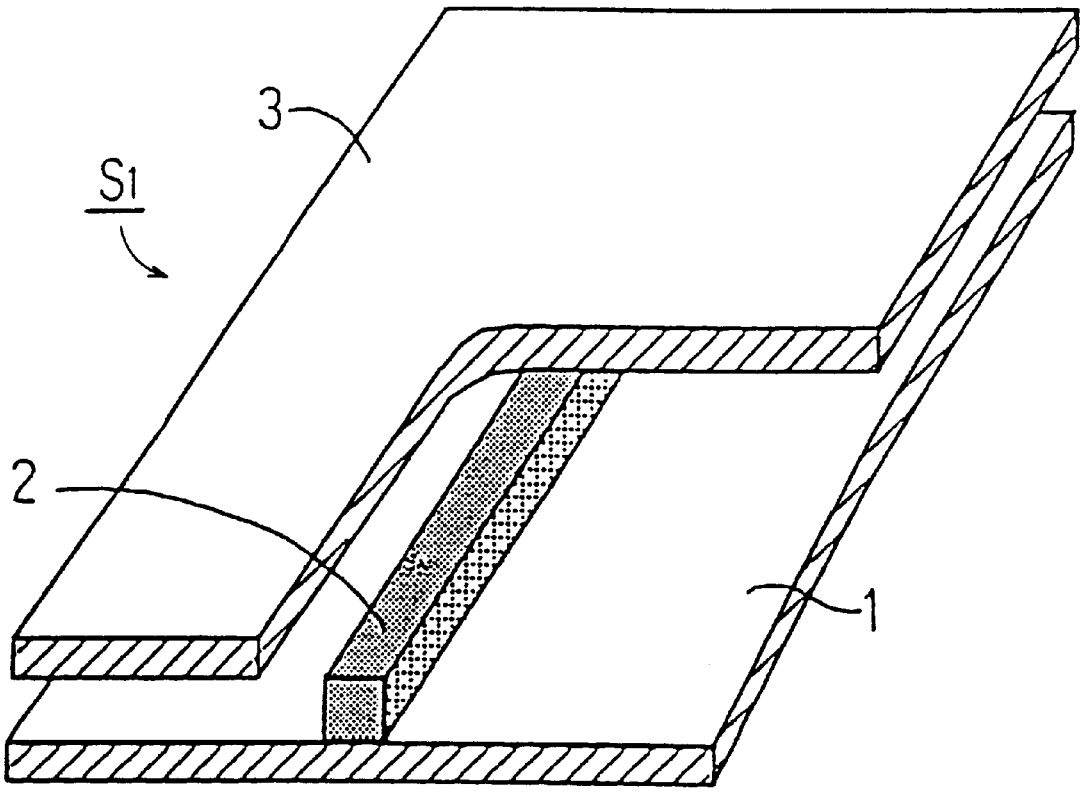
FIG. 17 PRIOR ART
FIG. 17 is a partially cutaway perspective view showing a conventional single-strip type of NRD guide S1.
Figure 18:
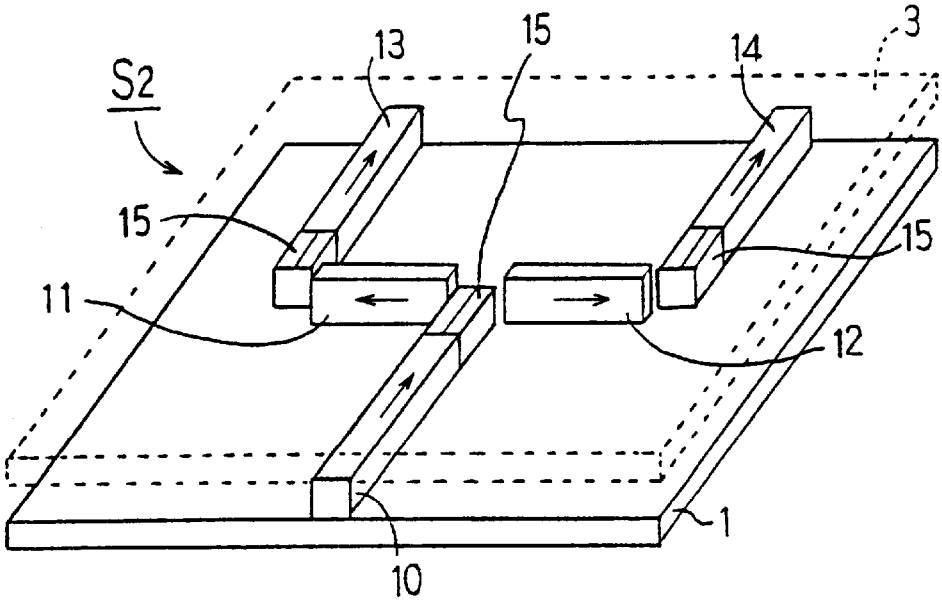
FIG. 18 PRIOR ART
FIG. 18 is a perspective view showing the inside of an NRD guide S2 constituting a straight branch circuit.

With regard to the NRD guide S of the invention, a transmission property of millimeter-waves (in a band of tens to hundreds GHz) measured by a network analyzer (produced by Hewlett-Packard, Network Analyzer 8757C) will be shown in FIG. 16. FIG. 16 shows that the NRD guide S of the invention distributed high-frequency signals having nearly equal output levels to the output port 2*b* and the output port 4*c* within a wide frequency range of about 56–62 GHz.

By using the NRD guide S of an integrated branch structure of the invention, in a use for frequency modulation FM required in radar and transmission/reception devices, it is possible to attain an excellent effect that changes of the signal strength depending on the frequency would not occur. Therefore, the invention can attain an excellent property as a module.

Figure 20:
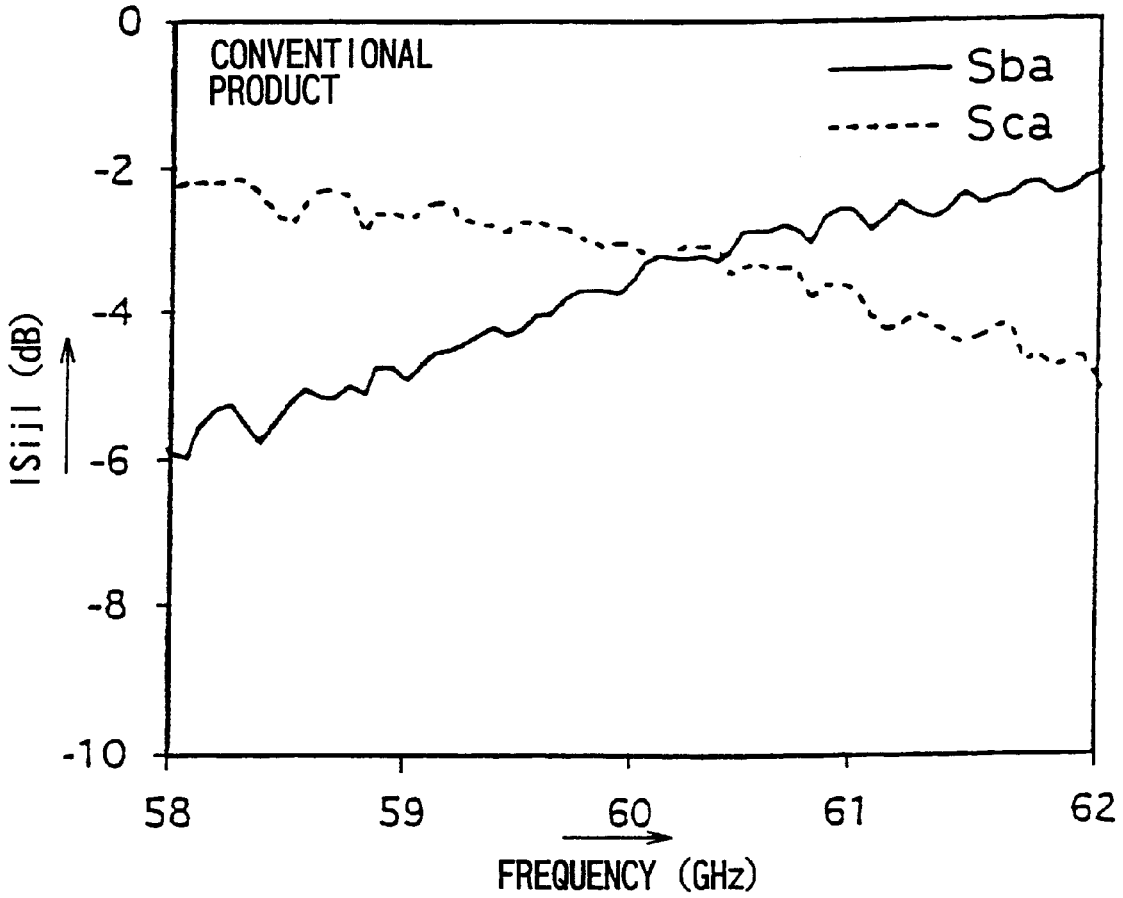
FIG. 20 PRIOR ART
FIG. 20 is a graph of the frequency response of the conventional NRD guide S3 as shown in FIG. 19.

On the contrary, as a result of a like measurement with regard to the coupler type of NRD guide S3 serving as a comparison example, as shown in FIG. 20, it was only in a rather narrow frequency range of 60–60.5 GHz that the output levels at the output port 20*b* and the output port 21*c* were almost equal.

Figure 6:
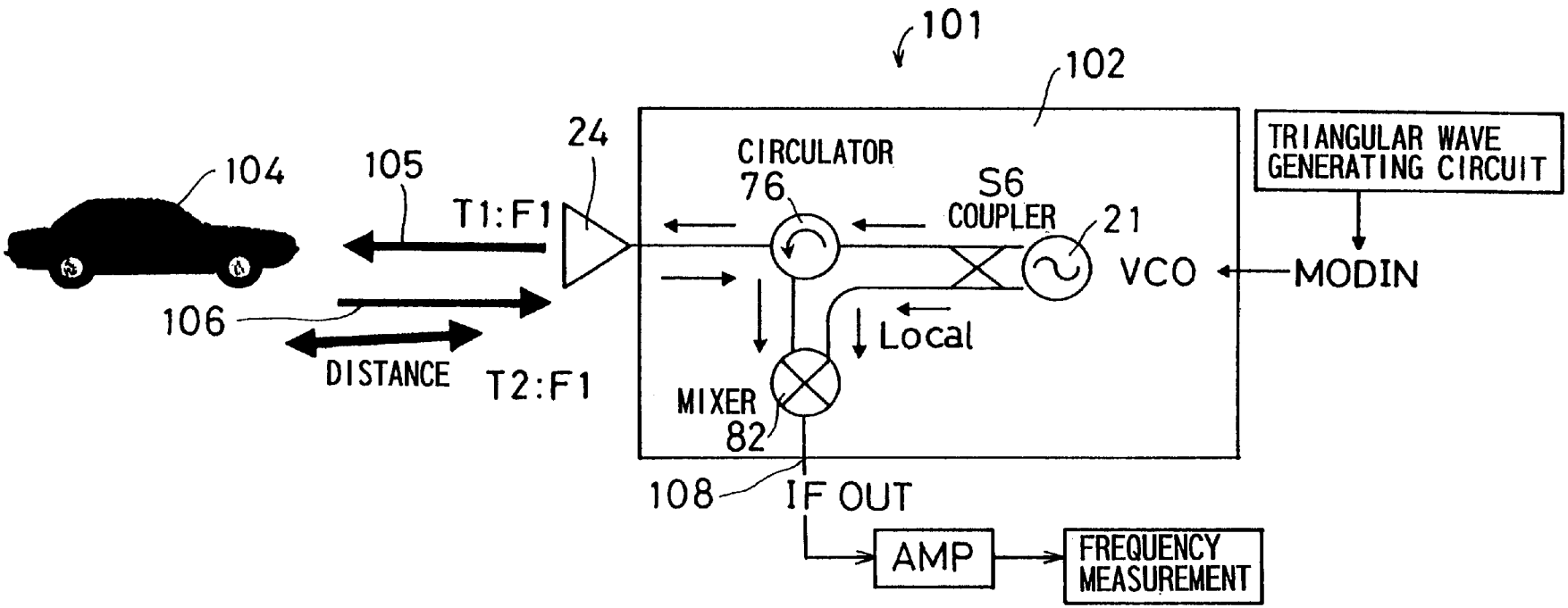
FIG. 6 is a block diagram showing a construction of part of a radar system 101 as an embodiment of the invention.

FIG. 6 is a block diagram showing a construction of part of a radar system 101 as an embodiment of the invention. The radar system 101 comprises a millimeter-wave radar module 102, wherein the module 102 includes an NRD guide S6 working as a coupler.

Figure 7:
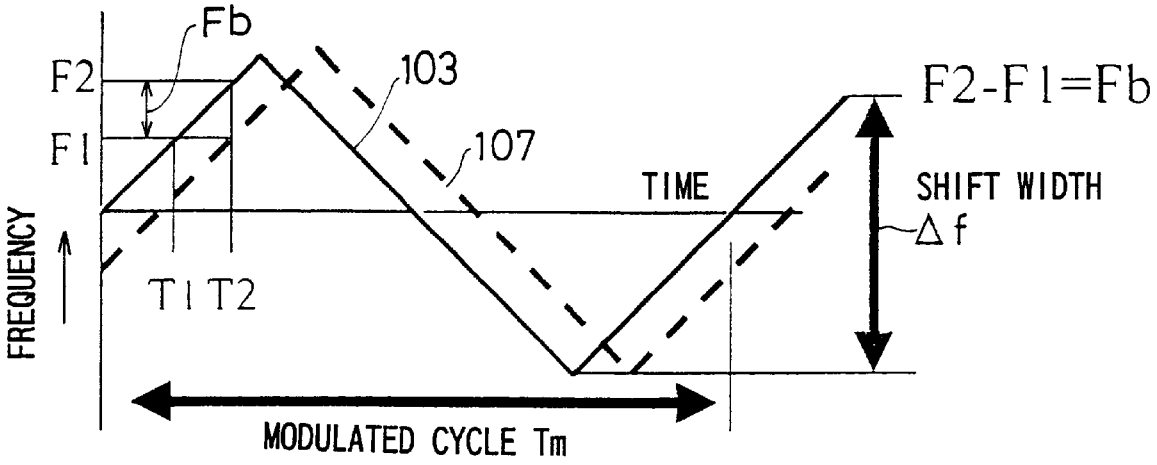
FIG. 7 is a view of assistance in explaining operating principles of a millimeter-wave radar module 102 in FIG. 6.

The millimeter-wave radar module 102 as shown in FIG. 6 adopts the FMCW (frequency modulation continuous waves) system, the operating principles of which are as follows. Signals whose voltage amplitude changes over time forming triangular waves as shown by a solid line 103 in FIG. 7 are inputted to a MODIN terminal for inputting modulated signals of the voltage-controlled oscillating portion 21, the output signals are frequency-modulated, and the output frequency of the voltage-controlled oscillating portion 21 is shifted as shown on the vertical axis of FIG. 7. Then, when the output signals (radio waves) are radiated from the single transmission/reception antenna 24 as shown by an arrow 105, reflection waves (reception waves) 106 shown by a dot line 107 in FIG. 7 are returned with a time lag for round trip of the propagation speed of the radio waves in the case where the target 104 exists forward the transmission/reception antenna 24 as shown in FIG. 6. At this moment, to an IFOUT terminal 108 on the output side of the mixer 82, the frequency difference Fb (=F2−F1) between the solid line 103 and the dot line 107 in FIG. 7 is outputted.

By an analysis of frequency components such as the output frequency of the IFOUT terminal 108, a distance R can be given by the following expression:

$$Fb=4R\cdot fm\cdot \Delta f/c \tag{1}$$

wherein Fb=IF output frequency, R=distance, fm=modulated frequency, Δf=frequency shift width and c=light speed.

In the millimeter-wave radar 101 of FMCW system, a resolution in the direction of the target 104 needs to be about 1 m, and in order to obtain this resolution, a frequency change bandwidth of 150 MHz is required according to the following expression:

$$r=c/(2\cdot \Delta f) \tag{2}$$

wherein r=distance resolution, Δf=frequency shift width and c=light speed.

Figure 8:
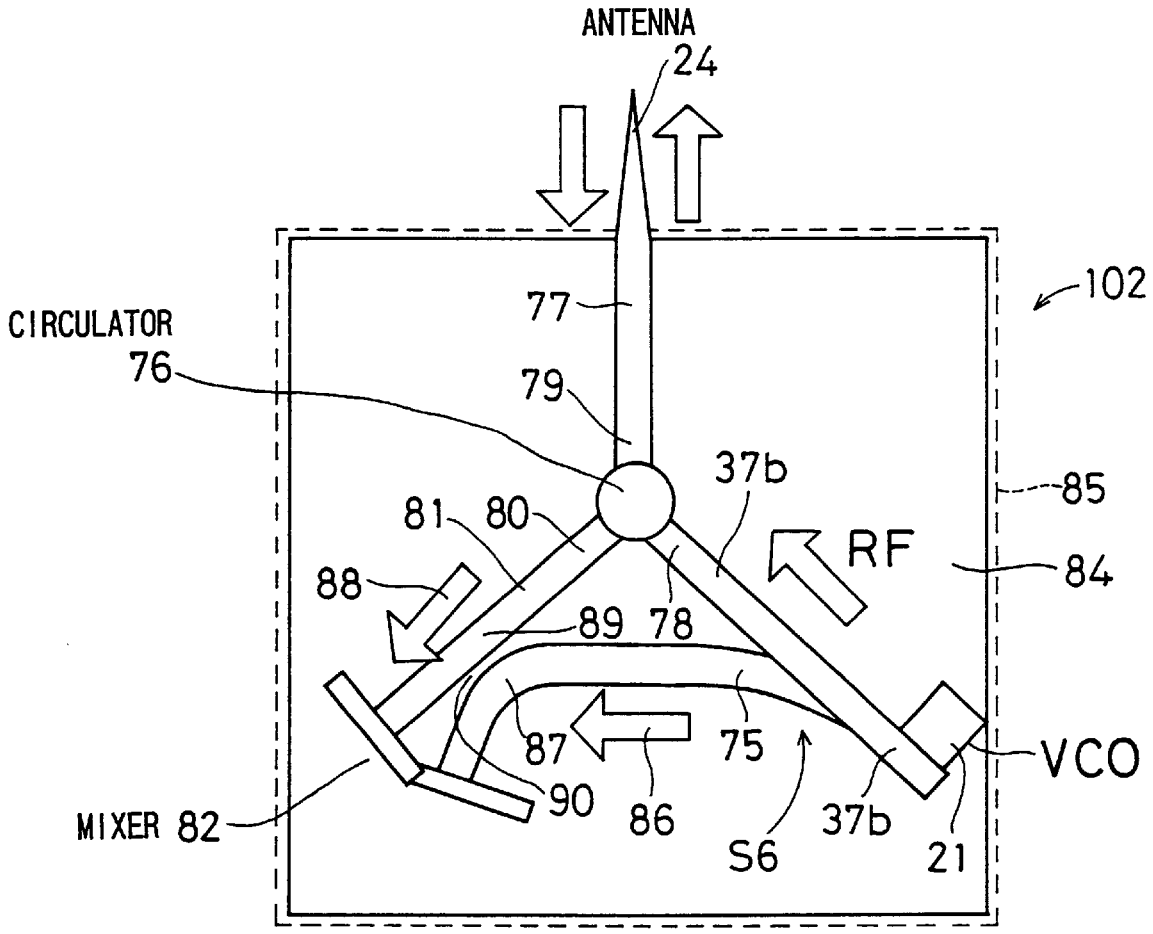
FIG. 8 is a plan view showing the simplified construction of the millimeter-wave radar module 102 mentioned before with reference to FIGS. 6 and 7.

FIG. 8 is a plan view showing the simplified construction of the millimeter-wave radar module 102 mentioned before with reference to FIGS. 6 and 7.

Figure 9:
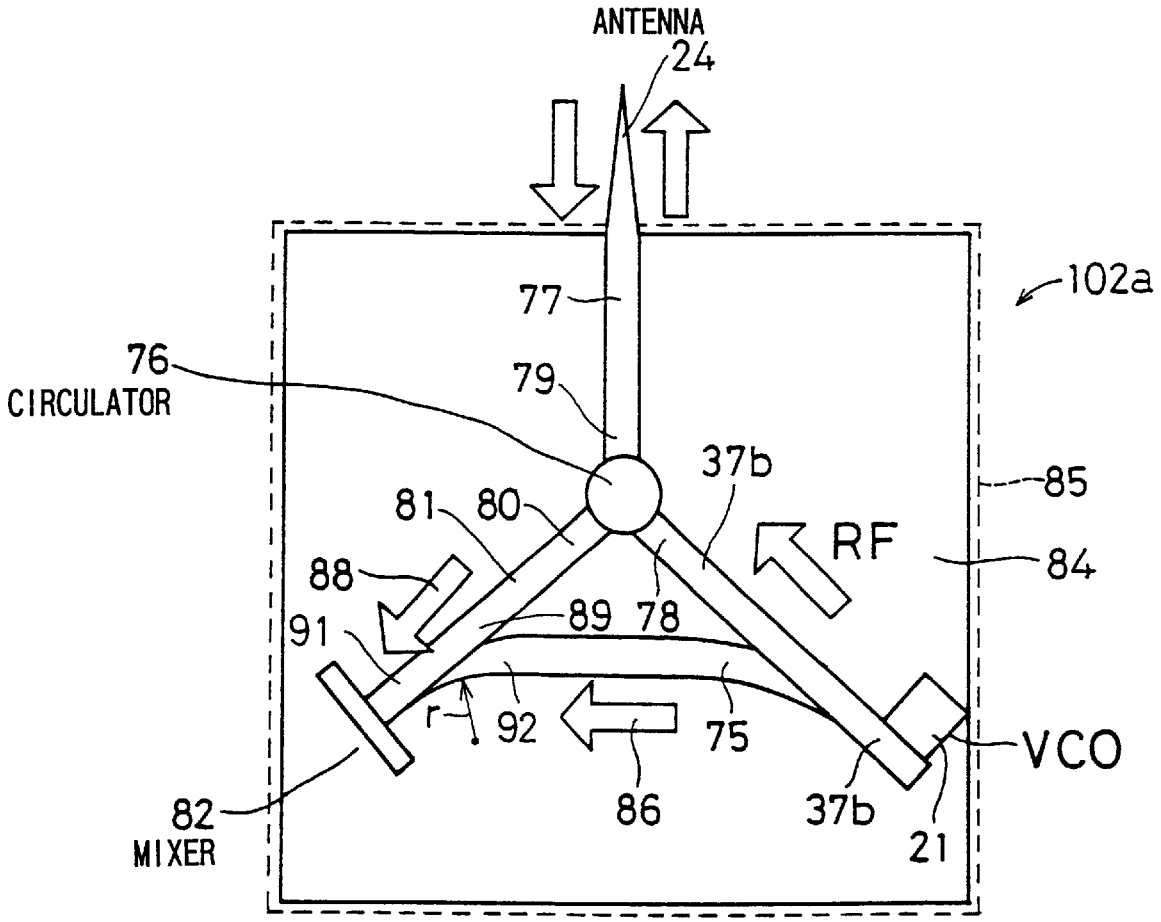
FIG. 9 is a simplified plan view of another millimeter-wave radar module 102*a* which can be embodied instead of the embodiment of FIGS. 6–8.

FIG. 9 is a simplified plan view of another millimeter-wave radar module 102*a* which can be embodied instead of the embodiment as shown in FIG. 8. An embodiment as shown in FIG. 9 is similar to the embodiment as shown in FIG. 8, and like elements will be denoted by like reference numerals. The millimeter-wave radar modules 102, 102*a* as shown in FIGS. 8 and 9 comprise the voltage-controlled oscillating portion 21.

Figure 10:
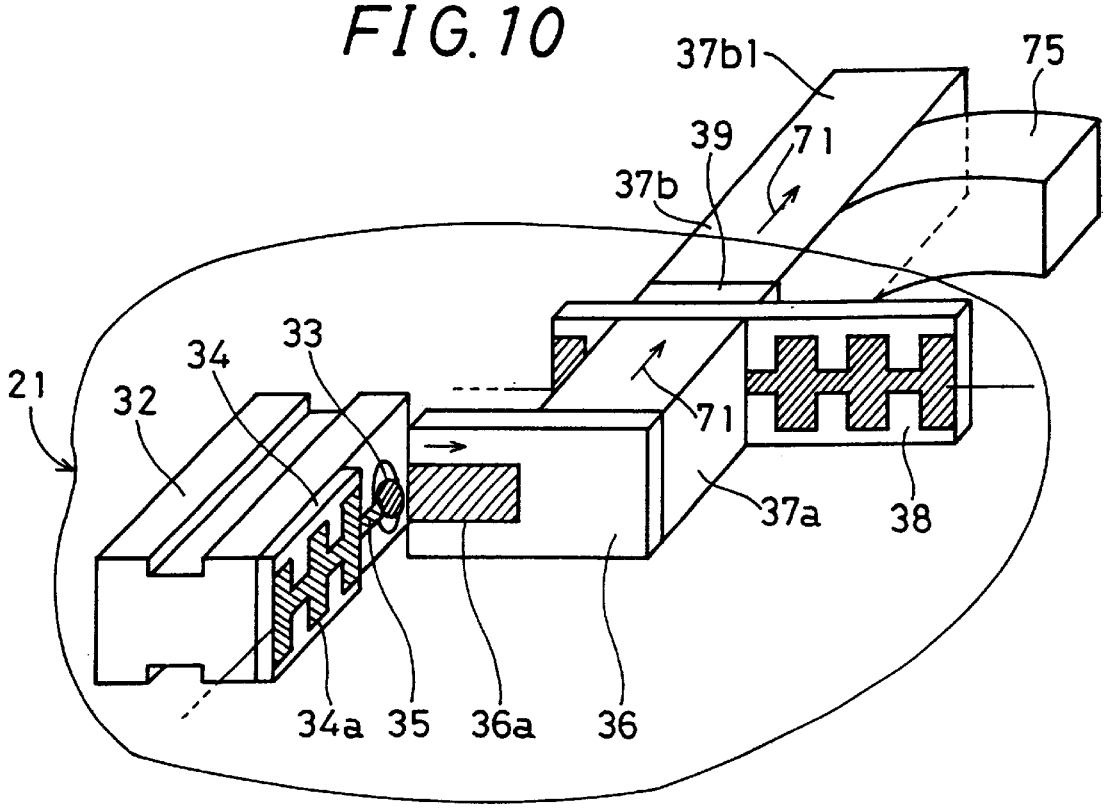
FIG. 10 is a perspective view showing the entire construction of an example of the voltage-controlled oscillating portion 21.
Figure 11:
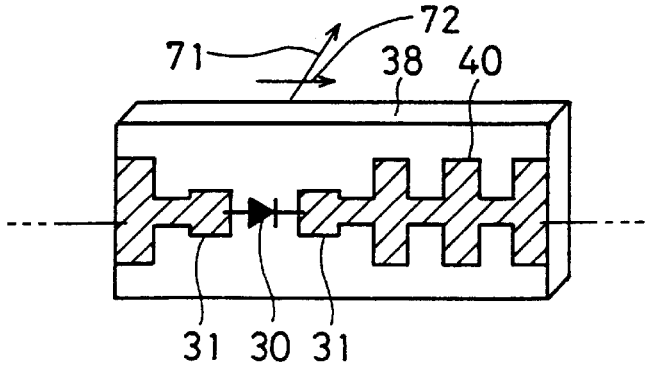
FIG. 11 is a perspective view of a wiring board 38 included by the voltage-controlled oscillating portion 21.

FIG. 10 is a perspective view showing the entire construction of an example of the voltage-controlled oscillating portion 21, and FIG. 11 is a perspective view of a wiring board 38 included by the voltage-controlled oscillating portion 21. The voltage-controlled oscillating portion 21 is constructed as shown in FIGS. 10 and 11. In these drawings, reference numeral 32 denotes a metal member such as a metal block for mounting a gun diode 33, reference numeral 33 denotes a gun diode which is a kind of high-frequency diodes generating millimeter-waves, reference numeral 34 denotes a wiring board which is mounted on one side surface of the metal member 32 and provided with a choke-type bias supply strip 34*a* supplying bias voltage to the gun diode 33 and working as a low-pass filter for preventing high-frequency signals from leaking, reference numeral 35 denotes a band-shaped conductor such as a metal foil ribbon which connects the choke-type bias supply strip 34*a* to the upper conductor of the gun diode 33, reference numeral 36 denotes a metal strip resonator made by disposing a resonating metal strip 36*a* to a dielectric base, and reference numerals 37*a*, 37*b* denote a dielectric strip which guides high-frequency signals of, for example, 70 GHz resonated by the metal strip resonator 36 to the outside of the voltage-controlled oscillating portion 21.

Further, a wiring board 38 provided with a varactor diode 30, which is a frequency-modulating diode as well as a kind of variable capacitance diodes, is mounted midway the dielectric strips 37*a*, 37*b*. A bias voltage applying direction of the varactor diode 30 is selected to be a direction 72 (electric field direction) which is perpendicular to the propagating direction 71 of high-frequency signals in the dielectric strips 37*a*, 37*b* as well as parallel to the main surfaces of the parallel plate conductors. Moreover, the bias voltage applying direction of the varactor diode 30 coincides with the electric field direction of high-frequency signals of $LSM_{01}$ mode which propagate through the dielectric strips 37*a*, 37*b*. Therefore, by electromagnetically coupling high-frequency signals and the varactor diode 30 and controlling bias voltage, it is possible to control the frequency of the high-frequency signals. In addition, reference numeral 39 denotes a dielectric plate having high dielectric constant for matching impedance of the varactor diode 30 to that of the dielectric strip 37*b*.

Furthermore, as shown in FIG. 11, a second choke-type bias supply strip 40 is formed on one main surface of the wiring board 38, and the beam-lead-type varactor diode 30 is mounted midway the second choke-type bias supply strip 40. A connecting electrode 31 is formed at a junction of the second choke-type bias supply strip 40 to the varactor diode 30.

High-frequency signals generated by the gun diode 33 are guided through the metal strip resonator 36 to the dielectric strip 37*a*. Subsequently, part of the high-frequency signals are reflected by the varactor diode 30 and returned toward the gun diode 33. The reflection signals change according to the change of capacitance of the varactor diode 30, and then the oscillation frequency changes.

Further, the varactor diode 30, instead of being interposed between the first dielectric strips 37*a*, 37*b*, may be spatially electromagnetically coupled to a transmission path of high-frequency signals, or may be arranged on the transmission path of high-frequency signals. For example, the varactor diode 30 as shown in FIG. 11 is arranged to be close to a metal strip 36*a* stripe in which resonance of high-frequency signals occurs, in a state where the bias voltage applying direction coincides with the electric field direction of the high-frequency signals. Alternatively the varactor diode 30 may be arranged to be directly close to the gun diode 33 in a state where the bias voltage applying direction coincides with the electric field direction of the high-frequency signals, or may be arranged in a choke-type bias supply strip 34*a* of the gun diode 33.

The material of the choke-type bias supply strip 34*a* and the band-shaped conductor 35 of the voltage-controlled oscillating portion 21 as shown in FIGS. 10 and 11 is Cu, Al, Au, Ag, W, Ti, Ni, Cr, Pd, Pt or the like, and specifically, Cu and Ag are preferable because they exhibit a preferable electric conductivity, low losses and high oscillation outputs.

Further, the band-shaped conductor 35 is electromagnetically coupled to the metal member 32 to keep a specific spacing from the surface of the metal member 32, and bridged between the choke-type bias supply strip 34*a* and the gun diode device 33. That is to say, one end of the band-shaped conductor 35 is soldered to one end of the choke-type bias supply strip 34*a* and the other end of the band-shaped conductor 35 is soldered to the upper conductor of the gun diode device 33, whereby the band-shaped conductor 35 excluding the junctions is suspended in midair.

Since the metal member 32 also establishes a ground for the gun diode device 33, it only needs to be a metal conductor, the material of which is not restricted as long as the metal member is a metal (including alloy) conductor. Therefore, the metal member is made of brass (Cu—Zn alloy), Al, Cu, SUS (stainless steel), Ag, Au, Pt or the like. Further, the metal member 32 may be: (a) a metal block entirely made of metal; (b) an insulation base such as ceramics or plastic, the surface of which is entirely or partly metal plated; or (c) an insulation base, the surface of which is entirely or partly coated with a conductive resin material or the like.

Further, it is preferable that the material of the dielectric strips 37*a*, 37*b* is a sinter whose major constituent is a Mg—Al—Si composite oxide such as cordierite ($2MgO.2Al_2O_3.5SiO_2$) ceramics, or may be alumina ($Al_2O_3$) ceramics, glass ceramics or the like. These materials exhibit low losses in a high-frequency band. Specifically, with a sinter whose major constituent is a Mg—Al—Si composite oxide, it is possible to produce a dielectric strip which exhibits low losses in a high-frequency band.

In the invention, it is preferable that the dielectric strip is made of a sinter whose major constituent is a Mg—Al—Si composite oxide, more specifically, cordierite ceramics or the like. It is preferable that the dielectric constant of the sinter mentioned above is about 4.5–8. The reason for limiting the dielectric constant to this range is that in the case where the dielectric constant is less than 4.5, electromagnetic waves of the LSM mode in a propagation mode are largely converted to the LSE mode. On the other hand, in the case where the dielectric constant is more than 8, it is necessary to make the width of the dielectric strip considerably narrow for using in the frequency of 50 GHz or more, so that processing the strip is difficult, the accuracy of shape is degraded and a problem regarding strength occurs.

Further, it is preferable to use, as the material of the dielectric strip, ceramics whose major constituent is a Mg—Al—Si composite oxide with the value of Q of 1000 or more in the use frequency of 50–90 GHz. This material attains a sufficient low-loss property as a dielectric strip used in 50–90 GHz included in a millimeter-wave band recently.

It is preferable that the composition and the composition ratio of the dielectric strip satisfy a mole ratio composition expression of $xMgO.yAl_2O_3.zSiO_2$, wherein x=10–40 mole %, y=10–40 mole %, z=20–80 mole % and x+y+z=100 mole %.

The reason for limiting the composition ratio of the major constituent of ceramics (dielectric porcelain composite), which is a material of the dielectric strip of the invention, to the above-mentioned range is as follows. A subscript x denoting mole % of MgO is limited to 10–40 mole %, because a preferable sinter cannot be obtained in the case of less than 10 mole %, whereas the dielectric constant gets high in the case of more than 40 mole %. In specific, the subscript x is preferably 15–35 mole % in view of selecting the value of Q in 60 GHz to be 2000 or more.

Further, a subscript y denoting mole % of $Al_2O_3$ is limited to 10–40 mole %, because a preferable sinter cannot be obtained in the case where the amount y of $Al_2O_3$ is less than 10 mole %, whereas the dielectric constant gets high in the case of more than 40 mole %. The subscript y denoting the amount of $Al_2O_3$ is preferably 17–35 mole % in view of selecting the value of Q in 60 GHz to be 2000 or more.

A subscript z denoting mole % of $SiO_2$ is limited to 20–80 mole %, because the dielectric constant gets high in the case where the subscript z is less than 20 mole %, whereas a preferable sinter cannot be obtained and the value of Q is lowered in the case of more than 80 mole%. The subscript z denoting the amount of $SiO_2$ is preferably 30–65 mole % in view of selecting the value of Q in 60 GHz to be 2000 or more.

The subscripts x, y, z denoting mole % of MgO, $Al_2O_3$, $SiO_2$ can be specified in an analysis method such as the EPMA (electron probe micro analysis) method or the XRD (X-ray diffraction) method.

Further, regarding ceramics (dielectric porcelain composite) for the dielectric strip of the invention, the major crystal phase thereof is cordierite ($2MgO.2Al_2O_3.5SiO_2$). As other crystal phases, mullite ($3Al_2O_3.2SiO_2$), spinel ($MgO.Al_2O_3$), protoenstatite {a kind of steatite whose major constituent is magnesium metasilicate ($MgO.SiO_2$)}, crinoenstatite {a kind of steatite whose major constituent is magnesium metasilicate ($MgO.SiO_2$)}, forsterite ($2MgO.SiO_2$), cristobalite {a kind of silicate ($SiO_2$) }, tridymite {a kind of silicate ($SiO_2$) }, sapphirine (a kind of silicate of Mg, Al) and the like are often deposited. The deposition phase is different depending on the composition. Dielectric porcelain composite of the invention may have a crystal phase of cordierite alone.

Dielectric porcelain composite for the dielectric strip of the invention is produced in the following manner. As powders of raw material, $MgCO_3$ powder, $Al_2O_3$ powder and $SiO_2$ powder are used, for example. These powders are measured and wet mixed in the specific proportions, and then dried. The mixture is presintered at 1100–1300° C. in the air and crushed into powder. The obtained powder, to which a proper amount of resin binder is added, is molded, and the molded member is sintered at 1300–1450° C. in the air, whereby dielectric porcelain composite can be obtained.

The respective elements Mg, Al, Si contained in the powders of raw material may be an inorganic compound such as oxide, carbonate or acetate, or an organic compound such as organic metal. They can be anything that can become oxide by sintering.

The major constituent of dielectric porcelain composite of the invention is Mg—Al—Si composite oxide, and in a range not to impair the property that the value of Q at 50–90 GHz is 1000 or more, impurities of crush ball or powder of raw material other than the above-mentioned elements may be mixed in, and other constituents may be contained in order to control a sintering temperature range and enhance a mechanical property. For example, such constituents are rare-earth element compound, oxide such as Ba, Sr, Ca, Ni, Co, In, Ga or Ti, and non-oxide such as nitride like silicon nitride. A single constituent may be contained, or a plurality of constituents may be contained.

Referring to FIG. 8 again, a millimeter-wave radar module 102 includes a high-frequency diode 33, first dielectric strips 37*a*, 37*b*, a voltage-controlled oscillating portion 21, a second dielectric strip 75, a circulator 76, a third dielectric strip 77, a fourth dielectric strip 81, a mixer 82, and a pair of conductor plates 84, 85.

The high-frequency diode 33 outputs high-frequency signals of millimeter-wave band. One end of the first dielectric strips 37*b* (37*a*) are connected to the high-frequency diode 33, and the first dielectric strips 37*a*, 37*b* propagate high-frequency signals outputted by the high-frequency diode 33. A variable capacitance diode 30 is interposed midway in a transmitting direction 71 of the first dielectric strips 37*a*, 37*b*, the variable capacitance diode 30 outputs transmission millimeter-wave signals, which are the high-frequency signals frequency-modulated by modulated waves obtained by periodically controlling bias voltage of a variable capacitance diode 30 placed so that a bias voltage applying direction 72 coincides with an electric field direction of the high-frequency signals. The second dielectric strip 75 is joined, along an arc having a radius of curvature r not less than the wavelength λ of the transmission millimeter-wave signals, to a straight portion 37*b*1 of the first dielectric strip 37*b* on the downstream side from the variable capacitance diode 30 in the direction 71 for transmitting the transmission millimeter-wave signals of the first dielectric strips 37*a*, 37*b*. Here, the straight portion 37*b*1 may be formed like an arc having a radius of curvature r, and the second dielectric strip 75 may be linearly joined to the arc-shaped portion. The circulator 76 has an input end 78, an input/output end 79 and an output end 80, and is connected to the other end of the first dielectric strip 37*b* at the input end 78. The circulator 76 outputs transmission millimeter-wave signals inputted into the input end 78 to the input/output end 79, and outputs reception signals inputted into the input/output end 79 to the output end 80. The third dielectric strip 77 is connected to the input/output end 79 of the circulator 76. One end of the fourth dielectric strip 81 is connected to the output end 80 of the circulator 76. The mixer 82 connects the second dielectric strip 75 and the fourth dielectric strip 81 to generate intermediate frequency signals of respective signals transmitted to the second and fourth dielectric strips 75, 81. A pair of conductor plates 84, 85 are placed in parallel at a spacing equal to or less than one half of the wavelength λ of the millimeter-wave signals, in which spacing are disposed the high-frequency diode 33, the first to fourth dielectric strips 37*a*, 37*b*; 75, 77, 81, the voltage-controlled oscillating portion 21, the circulator 76 and the mixer 82.

In this millimeter-wave radar module 102 of FIG. 8, the mixer 82 has a construction of electromagnetically coupling an arc-shaped portion 87 midway in a transmitting direction 86 of the second dielectric strip 75 to a straight portion 89 midway in a transmitting direction 88 of the fourth dielectric strip 81, so as to be in close proximity to each other. In this construction, the straight portion 89 may be formed like an arc. Further, the arc-shaped portion 87 may be formed straight, and the straight portion 89 may be formed like an arc.

Although the millimeter-wave radar module 102*a* in FIG. 9 is similar to the millimeter-wave radar module 102 of FIG. 8, in particular, in this millimeter-wave radar module 102*a* of FIG. 9, the mixer 82 has a construction of tangentially joining, to a straight portion 91 of the fourth dielectric strip 81, the second dielectric strip 75 along an arc-shaped portion 92 having a radius of curvature r not less than the wavelength λ of the transmission millimeter-wave signals. In this construction, the straight portion 91 may be formed like an arc having a radius of curvature r, and the second dielectric strip 75 may be linearly joined to the arc-shaped portion.

Figure 12:
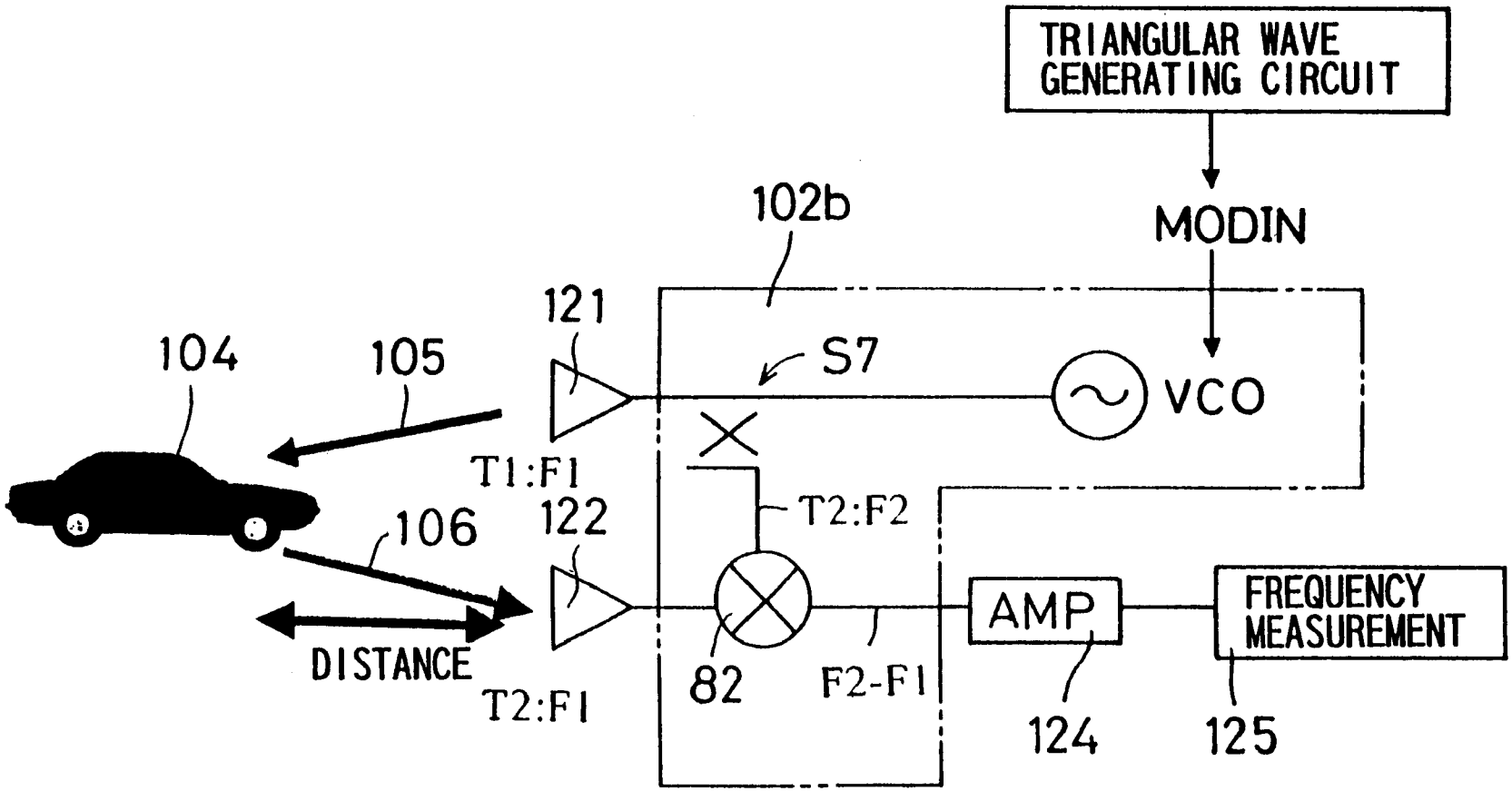
FIG. 12 is a block diagram showing the entire construction of millimeter-wave radar of another embodiment of the invention.

FIG. 12 is a block diagram showing the entire construction of millimeter-wave radar of another embodiment of the invention. This embodiment is similar to the above-mentioned embodiment, and corresponding portions are designated by the same reference characters. This millimeter-wave radar comprises a millimeter-wave radar module 102*b*.

Figure 13:
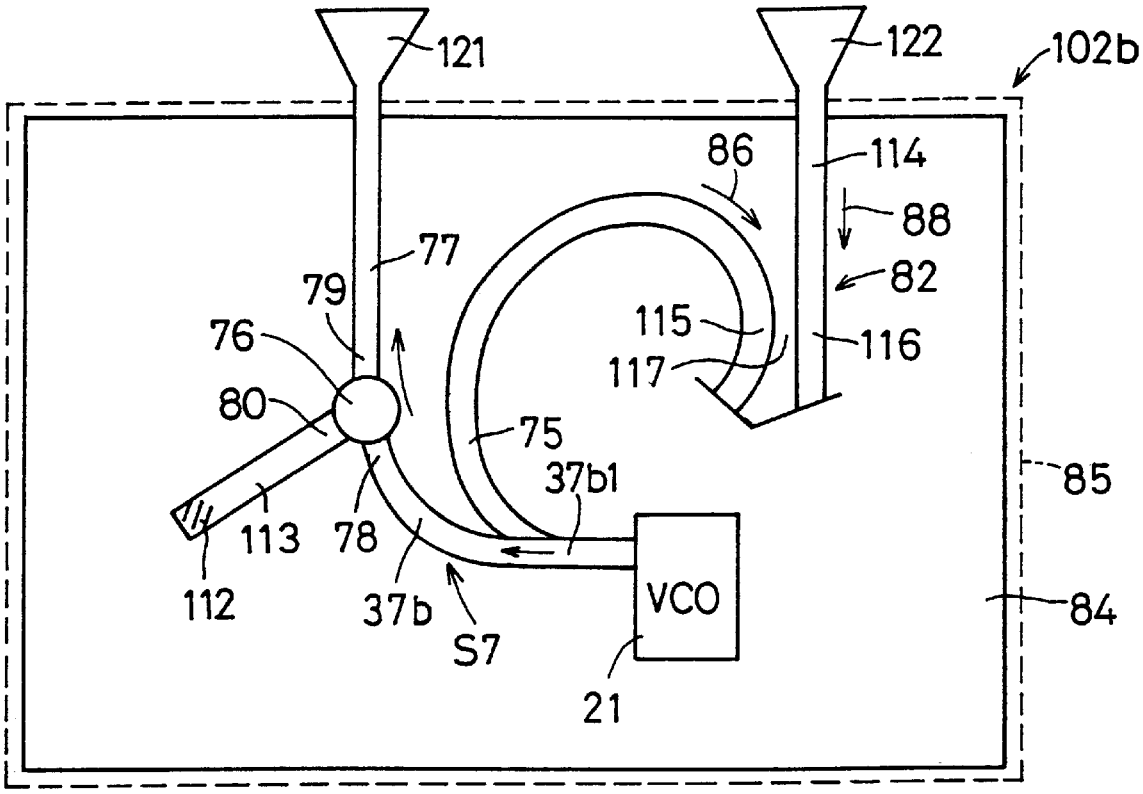
FIG. 13 is a simplified plan view showing a specific construction of a millimeter-wave radar module 102*b* as shown in FIG. 12.

FIG. 13 is a simplified plan view showing a specific construction of the millimeter-wave radar module 102*b* as shown in FIG. 12. This millimeter-wave radar module 102*b* includes the voltage-controlled oscillating portion 21 mentioned before with reference to FIGS. 10 and 11. This millimeter-wave radar module 102*b* includes a high-frequency diode 33, first dielectric strips 37*a*, 37*b*, a voltage-controlled oscillating portion 21, a second dielectric strip 75, a circulator 76, a third dielectric strip 77, a terminator 112, a fourth dielectric strip 114, a mixer 82, and a pair of conductor plates 84, 85. In FIG. 13, reference numeral 113 denotes a fifth dielectric strip, which has the terminator 112 at an end thereof opposite to the output end 80.

The high-frequency diode 33 outputs high-frequency signals of millimeter-wave band. One end of the first dielectric strips 37*b* (37*a*) are connected to the high-frequency diode 33, and the first dielectric strips 37*a*, 37*b* propagate high-frequency signals outputted by the high-frequency diode 33. A variable capacitance diode 30 is interposed midway in a transmitting direction 71 of the first dielectric strips 37*a*, 37*b*, the variable capacitance diode 30 outputs transmission millimeter-wave signals, which are the high-frequency signals frequency-modulated by modulated waves obtained by periodically controlling bias voltage of a variable capacitance diode 30 placed so that a bias voltage applying direction 72 coincides with an electric field direction of the high-frequency signals. The second dielectric strip 75 is joined, along an arc having a radius of curvature r not less than the wavelength λ of the transmission millimeter-wave signals, to a straight portion 37*b*1 of the first dielectric strip 37*b* on the downstream side from the voltage-controlled oscillating portion 21 in the direction 71 for transmitting the transmission millimeter-wave signals of the first dielectric strips 37*a*, 37*b*. Here, the straight portion 37*b*1 may be formed like an arc having a radius of curvature r, and the second dielectric strip 75 may be linearly joined to the arc-shaped portion. The circulator 76 has an input end 78, an input/output end 79 and an output end 80, and is connected to the other end of the first dielectric strip 37*b* at the input end 78. The circulator 76 outputs transmission millimeter-wave signals inputted into the input end 78 to the input/output end 79, and outputs reception signals inputted into the input/output end 79 to the output end 80. The third dielectric strip 77 is connected to the input/output end 79 of the circulator 76. The terminator 112 is connected to the output end 80 of the circulator 76. The fourth dielectric strip 114 guides the received millimeter-wave signals. The mixer 82 connects the second dielectric strip 75 and the fourth dielectric strip 114 to generate intermediate frequency signals of respective signals transmitted to the second and fourth dielectric strips 75, 114. A pair of conductor plates 84, 85 are placed in parallel at a spacing equal to or less than one half of the wavelength λ of the millimeter-wave signals, in a spacing between the conductor plates 84, 85, the high-frequency diode 33, the first to fourth dielectric strips 37*a*, 37*b*; 75, 77, 114, the voltage-controlled oscillating portion 21, the circulator 76 and the mixer 82 are disposed.

To the third dielectric strip 77 is connected a transmission antenna 121 which transmits millimeter-waves 105 toward the target 104. Reflected waves 106 from the target 104 are received by a reception antenna 122. An output of the reception antenna 122 is supplied to the fourth dielectric strip 114. The millimeter-wave radar module 102*b* may includes the transmission antenna 121 and reception antenna 122.

Intermediate frequency signals from the mixer 82 is supplied through the fourth dielectric strip 114 to an amplifier 124 to be amplified and thereafter is supplied to a frequency measuring circuit 125 to measure the frequency Fb. The other constitutions and operations are the same as those in the foregoing embodiment.

In the millimeter-wave radar module 102*b* of FIG. 13, the mixer 82 has a construction of electromagnetically coupling an arc-shaped portion 115 midway in a transmitting direction 86 of the second dielectric strip 75 to a straight portion 116 midway in a transmitting direction 88 of the fourth dielectric strip 114, so as to be in close proximity to each other.

In this construction, the straight portion 116 may be formed like an arc. Further, the arc-shaped portion 115 may be formed straight, and the straight portion 116 may be formed like an arc.

Figure 14:
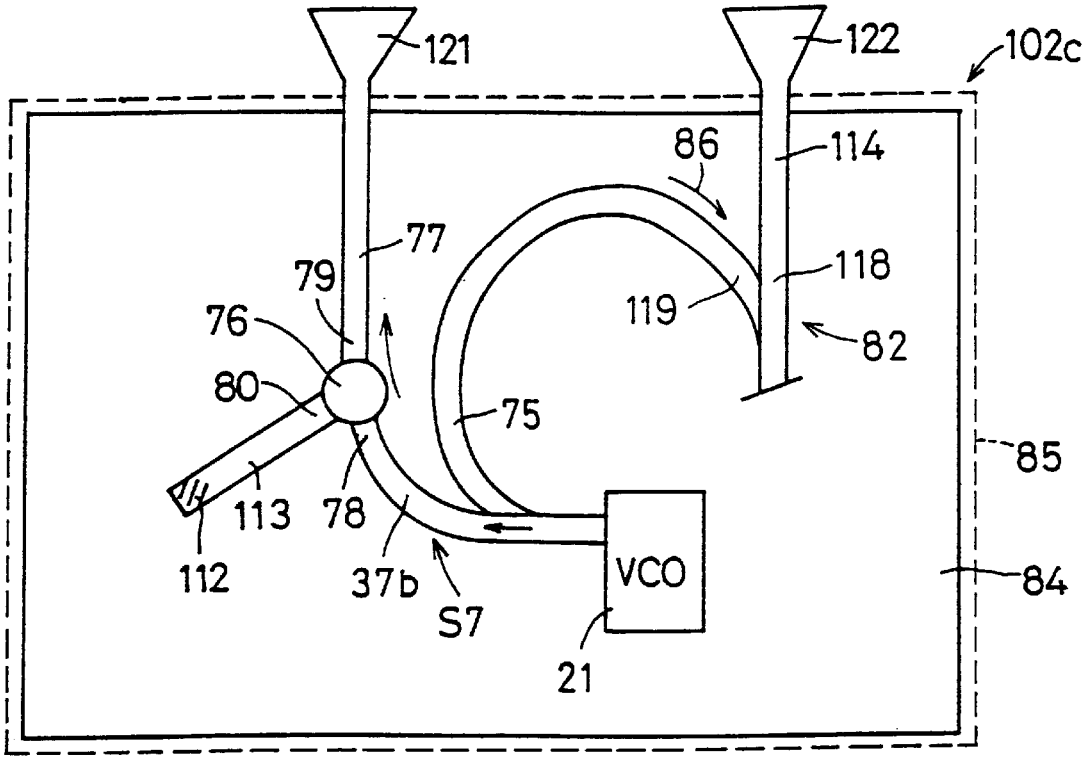
FIG. 14 is a simplified plan view showing a millimeter-wave radar module 102*c* of another embodiment of the invention.

FIG. 14 is a simplified plan view showing a millimeter-wave radar module 102*c* of another embodiment of the invention. Although the millimeter-wave radar module 102*c* in FIG. 14 is similar to the millimeter-wave radar module 102*b* of FIG. 13, in particular, in this millimeter-wave radar module 102*c* of FIG. 14, the mixer 82 has a construction of tangentially joining, to a straight portion 118 of the fourth dielectric strip 114, the second dielectric strip 75 along an arc-shaped portion 119 having a radius of curvature r not less than the wavelength λ of the received millimeter-wave signals.

In this construction, the straight portion 118 may be formed like an arc having a radius of curvature r, and the second dielectric strip 75 may be linearly joined to the arc-shaped portion.

Figure 15:
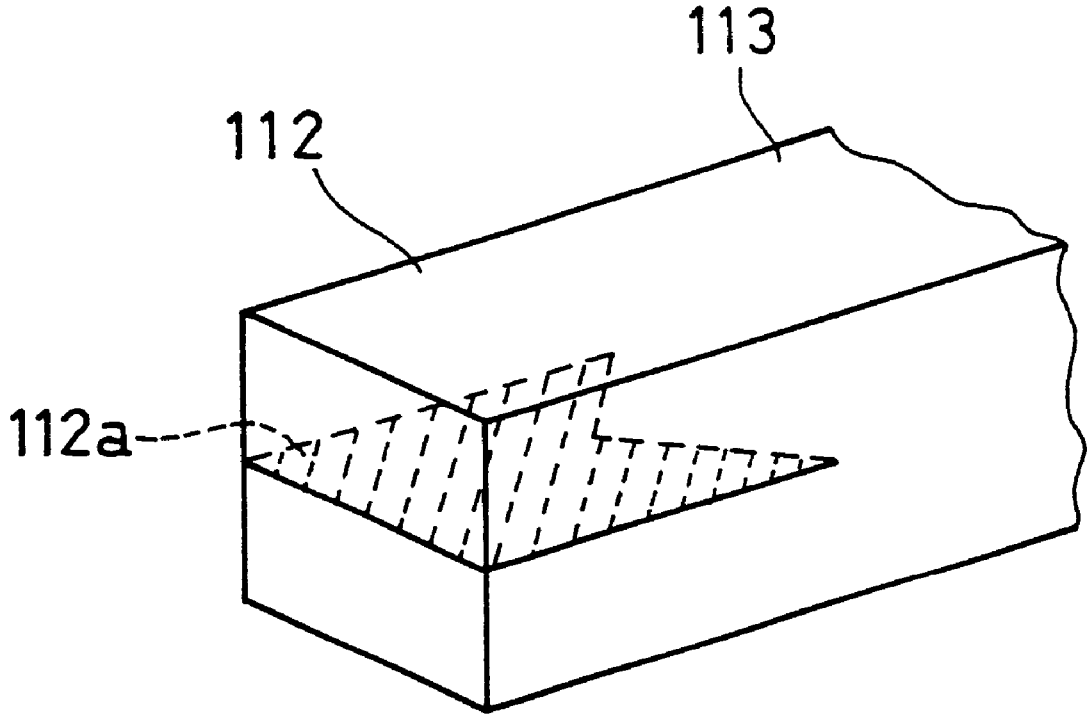
FIG. 15 is a view showing a structure of a terminator 112 disposed at one end of a fifth dielectric strip 113 as shown in FIGS. 13 and 14.

The nonreflective terminator 112 disposed at one end of the fifth dielectric strip 113 as shown in FIGS. 13 and 14 has the following structure. As shown in FIG. 15, the fifth dielectric strip 113 is divided into substantially equal two portions in a direction parallel to the parallel plate conductors (horizontal direction), and to a divided surface of one end of the fifth dielectric strip 113 is applied a NiCr resistance film 112*a* or conductive resin coating film containing conductive particulates such as carbon. Additionally the NiCr resistance film 112*a* or conductive coating film may be formed also on side and end surfaces of the terminator 112.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A junction structure of dielectric strips comprising:

a first straight dielectric strip for propagating high-frequency signals; and a second dielectric strip which is joined to the first dielectric strip at a midway point thereof, wherein a junction between the second dielectric strip and the first dielectric strip is formed along an arc and the radius of curvature thereof is equal to or more than the wavelength of the high-frequency signals.

2. A nonradiative dielectric waveguide comprising:

the junction structure of dielectric strips of claim 1 disposed between parallel plate conductors placed at a spacing of λ/2 or less with respect to a wavelength λ of high-frequency signals.

3. The nonradiative dielectric waveguide of claim 2, wherein the radius of curvature of the junction between the second dielectric strip and the first dielectric strip is in a range of from λ to 3λ.

4. A nonradiative dielectric wave guide comprising:

a junction structure of dielectric strips comprising:

a first straight dielectric strip for propagating high-frequency signals having a first side and an opposing second side; and a second dielectric strip having a first side and an opposing second side, wherein the second dielectric strip is joined to the first side of the first dielectric strip at a midway point thereof, wherein a junction between the second dielectric strip and the first dielectric strip is formed along an arc and the radius of curvature thereof is equal to or more than the wavelength of the high-frequency signals, and wherein the first side of the first dielectric strip forms a tangent to the arc of the first side of the second dielectric strip.

5. The nonradiative dielectric waveguide of claim 2, wherein a frequency of the high-frequency signals is equal to or more than 50 GHz.

6. The nonradiative dielectric waveguide of claim 2, wherein the parallel plate conductors are made of Cu, Al, Fe, Ag, Au, Pt or stainless steel.

7. The nonradiative dielectric waveguide of claim 2, wherein the first dielectric strip and the second dielectric strip are made of an organic resin material, an organic-inorganic composite or ceramics.

8. The nonradiative dielectric waveguide of claim 4, wherein the second side of the first dielectric strip forms a tangent to the arc of the second side of the second dielectric strip.

9. The nonradiative dielectric waveguide of claim 4, wherein the radius of curvature of the junction between the second dielectric strip and the first dielectric strip is in a range of from $\lambda$ to $3\lambda$.

10. The nonradiative dielectric waveguide of claim 4, wherein the junction structure is disposed between parallel plate conductors placed at a spacing of $\lambda/2$ or less with respect to a wavelength $\lambda$ of high-frequency signals.

11. The nonradiative dielectric waveguide of claim 10, wherein the parallel plate conductors are made of Cu, Al, Fe, Ag, Au, Pt, or stainless steel.

12. The nonradiative dielectric waveguide of claim 4, wherein the first dielectric strip and the second dielectric strip are made of an organic resin material, an organic-inorganic composite or ceramics.

* * * * *

UNITED STATES PATENT AND TRADEMARK OFFICE

CERTIFICATE OF CORRECTION

PATENT NO. : 6,437,663 B1 
DATED : August 20, 2002
INVENTOR(S) : Hironori KII and Nobuki Hiramatsu It is certified that error appears in the above-identified patent and that said Letters Patent is hereby corrected as shown below:

Title page,
Above Item [56], add -- [30] Foreign Application Priority Data,
JP 11-120768 April 27, 1999 --.

Signed and Sealed this

Twenty-fifth Day of February, 2003

JAMES E. ROGAN
*Director of the United States Patent and Trademark Office*